US009997003B2

(12) United States Patent
Kobayashi et al.

(10) Patent No.: US 9,997,003 B2
(45) Date of Patent: Jun. 12, 2018

(54) PAPER SHEET HANDLING APPARATUS

(71) Applicant: GLORY LTD., Himeji-shi, Hyogo (JP)

(72) Inventors: Kiyoaki Kobayashi, Hyogo (JP); Hitoshi Kobayashi, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days. days.

(21) Appl. No.: 15/506,284

(22) PCT Filed: Aug. 18, 2015

(86) PCT No.: PCT/JP2015/004101
§ 371 (c)(1),
(2) Date: Feb. 24, 2017

(87) PCT Pub. No.: WO2016/031176
PCT Pub. Date: Mar. 3, 2016

(65) Prior Publication Data

US 2017/0256112 A1 Sep. 7, 2017

(30) Foreign Application Priority Data

Aug. 27, 2014 (JP) ..... 2014-172903

(51) Int. Cl.
*B65H 5/36* (2006.01)
*G07D 11/00* (2006.01)

(52) U.S. Cl.
CPC ..... *G07D 11/0021* (2013.01); *B65H 5/36* (2013.01); *G07D 11/0081* (2013.01);
(Continued)

(58) Field of Classification Search
CPC ..... B65H 5/36; B65H 2601/11; B65H 2402/411; B65H 2402/441; B65H 2701/1912; G07C 11/0021; G07C 11/0081
See application file for complete search history.

(56) References Cited

U.S. PATENT DOCUMENTS 6,206,368 B1 * 3/2001 Kobayashi ..... B65H 3/5261 271/10.11
7,203,448 B2 * 4/2007 Yokoi ..... G03G 21/1638 399/124

(Continued)

FOREIGN PATENT DOCUMENTS

JP 2013-250909 12/2013
JP 2013-250909 A 12/2013

*Primary Examiner* — Patrick Cicchino
(74) *Attorney, Agent, or Firm* — Renner, Kenner, Greive, Bobak, Taylor & Weber

(57) ABSTRACT

A paper sheet handling apparatus (banknote handling apparatus 100) includes: a housing 12; a transport path forming member 711 disposed inside the housing and configured to form a transport path that transports paper sheets while sandwiching each paper sheet in a direction of the thickness of the paper sheet; and a handing unit (non-bundling stacker module 54) disposed at a predetermined position inside the housing. When jamming of paper sheets occurs in the middle of the transport path, the transport path forming member is displaced so as to open the transport path, in a state where the inside of the housing is opened by an opening and closing unit being opened. The handling unit disposed adjacent to the transport path is movable from the predetermined position so as to form a space that allows the transport path forming member to be displaced.

9 Claims, 19 Drawing Sheets

(52) U.S. Cl.
CPC .. *B65H 2402/411* (2013.01); *B65H 2402/441* (2013.01); *B65H 2601/11* (2013.01); *B65H 2701/1912* (2013.01)

(56) References Cited

U.S. PATENT DOCUMENTS

| | | | | |
|---|---|---|---|---|
| 7,577,394 | B2 * | 8/2009 | Sekiya | B65H 5/062 271/264 |
| 7,865,110 | B2 * | 1/2011 | Yamazaki | G03G 21/1628 399/110 |
| 8,820,740 | B2 * | 9/2014 | Sugizaki | B65H 5/00 271/264 |
| 9,096,409 | B2 * | 8/2015 | Koyanagi | B65H 5/062 |
| 9,284,143 | B2 * | 3/2016 | Takahashi | B65H 1/266 |
| 2006/0280530 | A1 * | 12/2006 | Andoh | G03G 15/0131 399/301 |
| 2010/0207319 | A1 | 8/2010 | Sato et al. | |
| 2012/0261874 | A1 | 10/2012 | Arikata et al. | |

* cited by examiner

PAPER SHEET HANDLING APPARATUS

TECHNICAL FIELD

The techniques disclosed herein relate to a paper sheet handling apparatus.

BACKGROUND ART

Patent Literature 1 discloses a banknote depositing and dispensing machine as a paper sheet handling apparatus. This banknote depositing and dispensing machine is a large-scale apparatus installed on a floor. An upper part of the apparatus is configured as a handling unit that accommodates a recognition unit etc., while a lower part of the apparatus is configured as a storage unit that stores banknotes therein. In the storage unit, a plurality of storage modules are arranged side by side in a direction of the depth of the apparatus to make one line, and two lines of the storage modules are stacked in an up-down direction. A space between the storage modules stacked in the up-down direction is configured as a transport path for transporting banknotes. On the front side of the storage unit, a door which is connected by a hinge and can be opened and closed is provided. When the door is opened, the whole storage unit can be pulled out frontward. When jamming of banknotes occurs in the middle of the transport path between the storage modules stacked on each other in the up-down direction, the door is opened, and the whole storage unit is pulled out frontward, and then the upper storage module, of the storage modules stacked in the up-down direction, is lifted to open the transport path. Thus, the jammed banknotes can be removed by accessing the transport path.

Furthermore, in the upper handling unit of the banknote depositing and dispensing machine disclosed in Patent Literature 1, a transport path that transports banknotes while sandwiching the banknotes in a direction of the thickness of the banknotes is formed by transport path forming members including a transport belt, transport rollers, etc. When jamming of paper sheets occurs in the middle of the transport path, a cover of the handling unit is opened to expose the inside of the handling unit, and the transport path forming members are displaced to open the transport path.

Patent Literature 2 discloses a banknote processing machine as a paper sheet handling apparatus. This banknote processing machine is a desktop apparatus installed on a desk or a stand. An upper part of the apparatus is configured as a handling unit that accommodates a recognition unit etc., while a lower part of the apparatus is configured as a stacking unit that stacks banknotes. In this desktop banknote processing machine, the upper handling unit is connected by a hinge to the lower stacking unit, although not clearly described in Patent Literature 2. In this banknote processing machine, when jamming of banknotes occurs, the whole upper handling unit is pivoted upward to open an upper portion of the lower stacking unit upward to be accessed. Thus, the jammed banknotes can be removed.

CITATION LIST

Patent Literature

[PTL 1] Japanese Laid-Open Patent Publication No. 2012-226494

[PTL 2] Japanese Laid-Open Patent Publication No. 2013-250909

SUMMARY OF THE INVENTION

Problems to be Solved by the Invention

In the apparatus disclosed in Patent Literature 1, since the lower storage unit is configured to be pulled out frontward, a space large enough for pulling out the storage unit needs to be provided at the front side of the installed paper sheet handling apparatus. As a result, the paper sheet handling apparatus needs a space to install larger than itself. This configuration is particularly disadvantageous for a desktop apparatus because a large space is needed on a desk.

In addition, in the apparatus disclosed in Patent Literature 1, an empty space that allows the transport path forming members to be displaced should be provided in the upper handling unit in advance. Therefore, this configuration is disadvantageous in downsizing the apparatus, and in particular causes a serious problem in a desktop apparatus for which downsizing is strongly demanded.

In the apparatus disclosed in Patent Literature 2, since the whole upper handling unit is pivoted upward, a space that allows the pivoting should be provided around the apparatus in advance. This configuration also needs a large space for installation of the apparatus.

Further, in the paper sheet handling apparatus disclosed in Patent Literature 2, a horizontally extending transport path needs to be provided between the upper handling unit and the lower stacking unit so that the transport path is opened and can be accessed when the whole upper handling unit is pivoted upward. This configuration greatly restricts the layout of the transport path. In order to achieve downsizing of the paper sheet handling apparatus, it is advantageous that the layout of the transport path has a higher degree of freedom.

The techniques disclosed herein are made in view of the above-mentioned problems, and an object of the disclosure is to realize downsizing of a paper sheet handling apparatus and reduction in an installation space while ensuring a configuration that can resolve a paper sheet jam.

Solution to the Problems

The technique disclosed herein relates to a paper sheet handling apparatus. This paper sheet handling apparatus includes: a housing having an opening that is opened and closed by an opening and closing unit, the housing being configured so that the inside thereof can be opened through the opening when the opening and closing unit is opened; a transport path forming member disposed inside the housing, the transport path forming member being configured to form a transport path that transports paper sheets while sandwiching each paper sheet in a direction of the thickness of the paper sheet; and a handing unit disposed at a predetermined position inside the housing, the handling unit being configured to perform predetermined handling on the paper sheets being transported by the transport path.

When jamming of paper sheets occurs in the middle of the transport path, the transport path forming member is displaced so as to open the transport path, in a state where the inside of the housing is opened by the opening and closing unit being opened. The handling unit disposed adjacent to the transport path is movable from the predetermined position so as to form a space that allows the transport path forming member to be displaced.

According to this configuration, when jamming of paper sheets does not occur and the paper sheet handling apparatus is operating normally, the handling unit in the housing is located at a predetermined position adjacent to the transport path. Here, the handling performed by the handling unit is handling in a broad sense, and the handling unit includes, for example, a recognition unit that recognizes paper sheets, a stacking unit that stacks paper sheets, a storage unit that stores paper sheets therein.

When jamming of paper sheets occurs, the opening and closing unit is opened to open and expose the inside of the housing, and in this state, the transport path is opened and can be accessed. At this time, the handling unit disposed adjacent to the transport path moves from the predetermined position so as to form a space that allows the transport path forming member to be displaced. Thus, the transport path forming member is displaced to open the transport path and be able to be accessed, whereby the paper sheets jammed in the middle of the transport path can be removed.

Thus, in the housing, a space for displacement of the transport path forming member is not provided in advance. Therefore, the paper sheet handling apparatus can be configured to be smaller in size. When jamming of paper sheets is to be resolved, a necessary space is formed by moving the handling unit, and the transport path forming member is displaced, whereby the transport path can be opened and accessed.

Since a space for displacement of the transport path forming member is not provided in advance, the degree of freedom in layout of the transport path in the housing is increased, and the degree of freedom in layout of the handling unit is also increased. This feature is also advantageous in downsizing the paper sheet handling apparatus. Therefore, this configuration can realize downsizing of the paper sheet handling apparatus and reduction in the installation space associated with the downsizing, while providing a structure capable of resolving jamming of paper sheets.

The housing has, separately from the above opening, a second opening that allows the inside of the housing to communicate with the outside thereof. When the handling unit is moved from the predetermined position, at least a portion thereof may protrude to the outside of the housing through the second opening.

When the handling unit is moved from the predetermined position, at least a portion of the handling unit protrudes to the outside of the housing through the second opening. This configuration allows empty space in the housing to be removed as much as possible, thereby realizing further downsizing of the paper sheet handling apparatus. When jamming of paper sheets occurs, it is only necessary to move the relatively small handling unit and cause at least a portion of the handling unit to protrude to the outside of the housing. Therefore, the empty space to be provided around the paper sheet handling apparatus may be smaller than the empty space required in the apparatus disclosed in Patent Literature 1 or Patent Literature 2. Thus, downsizing of the paper sheet handling apparatus and reduction in the installation space for the apparatus can be realized.

The handling unit may be configured to close the second opening in the state where the handling unit is disposed at the predetermined position.

Thus, in the normal state where no jamming of paper sheets occurs, the handling unit can also serve as a lid for closing the second opening provided in the housing.

A portion of the transport path may extend in an up-down direction inside the housing. The handling unit may be disposed to the side of the transport path extending in the up-down direction, and may be movable in a horizontal direction so as to be away from the transport path.

According to this configuration, even when the handling unit is disposed to the side of and adjacent to the transport path extending in the up-down direction, since the handling unit is movable in the horizontal direction so as to be away from the transport path, a space can be formed between the transport path and the handling unit. Thus, when jamming of paper sheets occurs, the transport path forming member is displaced by using this space, whereby the transport path can be opened.

In addition, an empty space to the side of the transport path extending in the up-down direction is removed by disposing the handling unit to the side of and adjacent to the transport path, whereby the width or depth of the paper sheet handling apparatus is reduced, and the installation area is reduced. This feature is advantageous in achieving downsizing of the paper sheet handling apparatus and reduction of the installation space.

The handling unit may be a stacker configured to stack the paper sheets.

Advantageous Effects of the Invention

As described above, according to the above-described paper sheet handling apparatus, downsizing of the paper sheet handling apparatus and reduction in the installation space can be achieved while ensuring a structure capable of resolving jamming of paper sheets.

DESCRIPTION OF EMBODIMENTS

Hereinafter, an embodiment will be described with reference to the drawings.

<Schematic Structure of Banknote Handling Apparatus>

Figure 1:
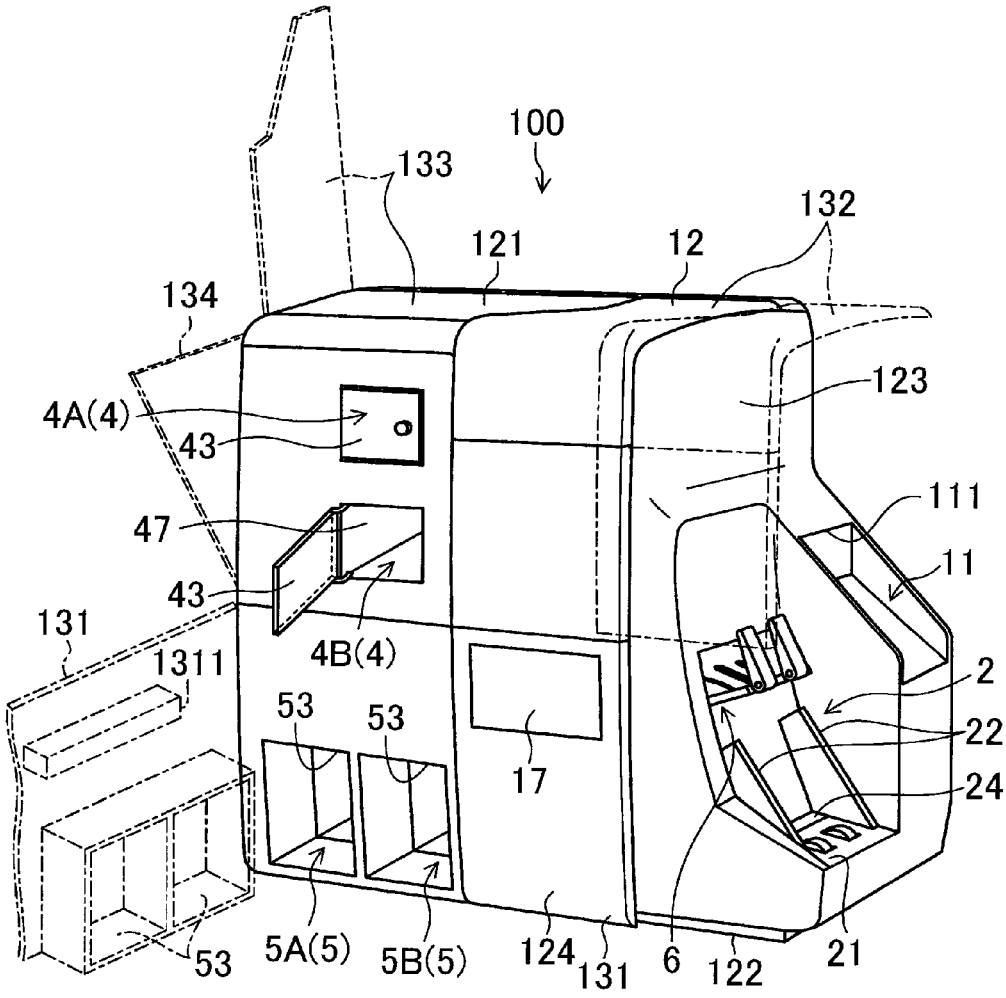
FIG. 1 is an external view of a banknote handling apparatus.
Figure 2:
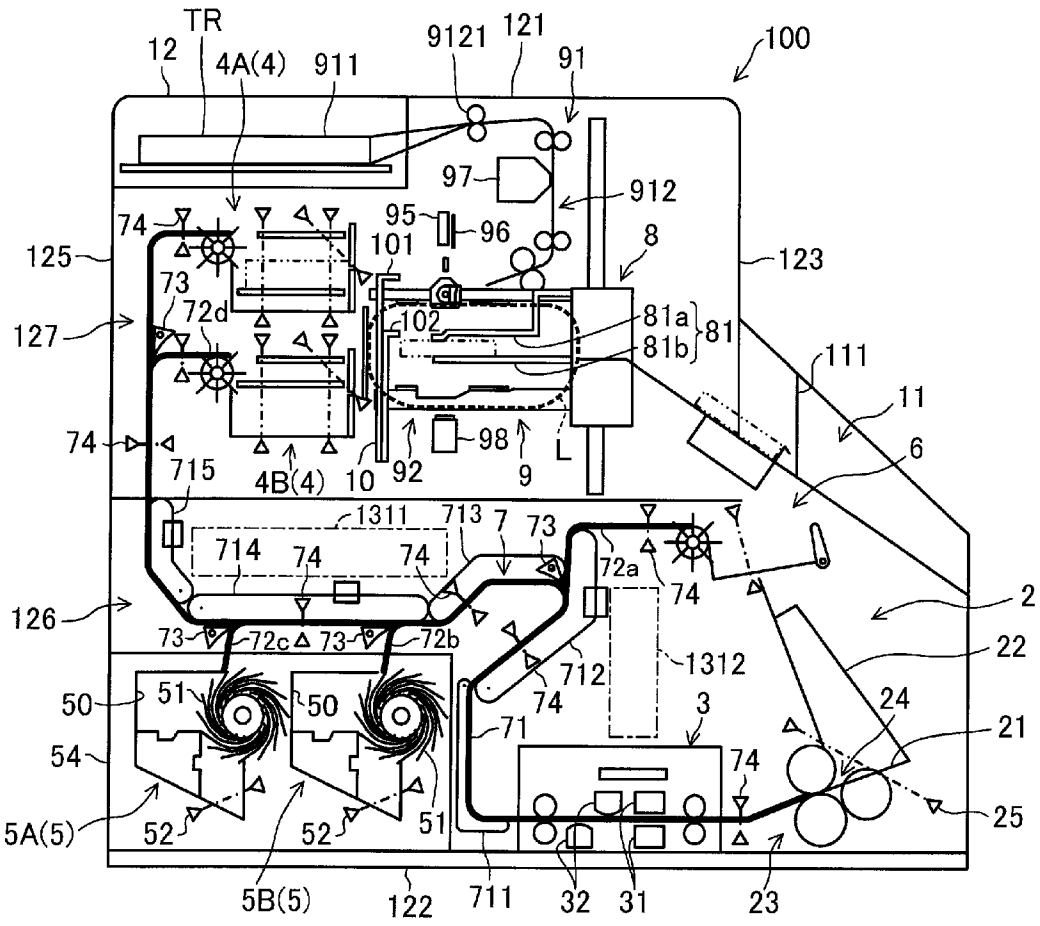
FIG. 2 is a schematic diagram showing the configuration of the banknote handling apparatus.

FIG. 1 is an external view of a banknote handling apparatus 100 as a paper sheet handling apparatus. FIG. 2 shows a schematic structure of the banknote handling apparatus 100.

The banknote handling apparatus 100 is placed on, for example, a teller counter of a bank, and used by an operator. The banknote handling apparatus 100 takes in loose banknotes, stacks a predetermined kind of banknotes, bundles a predetermined number of the banknotes, and dispenses the bundled banknotes.

The banknote handling apparatus 100 includes: a hopper unit 2, on which banknotes are placed, for taking in the banknotes; a recognition unit 3 that recognizes banknotes; a bundling stacker 4 that stacks banknotes to be bundled; a non-bundling stacker 5 that stacks banknotes not to be bundled; a reject stacker 6 that stacks rejected notes; a first transport unit 7 that transports the banknotes taken from the hopper unit 2 to the recognition unit 3, the bundling stacker 4, the non-bundling stacker 5, and the reject stacker 6; a second transport unit 8 that transports the banknotes stacked in the bundling stacker 4 to a predetermined position; a bundling unit 9 that bundles the banknotes transported by the second transport unit 8; a third transport unit 10 that transports the banknotes having been bundled (hereinafter, referred to as "bundled banknotes"); a dispense unit 11 by which the bundled banknotes are dispensed; and a box-shaped housing 12 that accommodates the recognition unit 3, the bundling stacker 4, the non-bundling stacker 5, the reject stacker 6, the first transport unit 7, the second transport unit 8, the bundling unit 9, and the third transport unit 10.

The housing 12 has an upper surface 121, a lower surface 122, and four side surfaces. The housing 12 is of a desktop type. That is, castors or the like are not provided on the lower surface 122 of the housing 12, and the housing 12 is configured to be installed on a desk or the like.

A first side surface 123, which is one of the four side surfaces of the housing 12, is provided with the hopper unit 2 and the dispense unit 11. A second side surface 124, which is one of the four side surfaces of the housing 12, is provided with a first outlet 47 of the bundling stacker 4 and second outlets 53 of the non-bundling stacker 5 (these outlets will be described in detail below). The first side surface 123 and the second side surface 124 are adjacent to each other.

The housing 12 is divided into a first handling unit 126 that performs handling associated with recognition and sorting of banknotes, and a second handling unit 127 that performs handling associated with bundling of banknotes to be bundled. The second handling unit 127 is disposed above the first handling unit 126. The first handling unit 126 includes the hopper unit 2, the recognition unit 3, the non-bundling stacker 5, and the reject stacker 6. The second handling unit 127 includes the bundling stacker 4, the second transport unit 8, the bundling unit 9, and the third transport unit 10. Most of the first transport unit 7 is included in the first handling unit 126. The first handling unit 126 is opened to be accessed through an opening 1210 provided in the housing 12 when a lower cover 131 described below is opened (also refer to FIG. 3).

The bundling stacker 4 includes two stackers which are a first bundling stacker 4A and a second bundling stacker 4B. Both the first bundling stacker 4A and the second bundling stacker 4B stack banknotes to be bundled. The type of banknotes to be stacked and subsequently bundled can be chosen beforehand.

The non-bundling stacker 5 includes two stackers which are a first and a second non-bundling stackers 5A, 5B. The first and the second non-bundling stackers 5A, 5B are aligned substantially in the horizontal direction in the first handling unit 126. The two non-bundling stackers 5A, 5B are integrated with each other to form a non-bundling stacker module 54. The non-bundling stacker module 54, which will be described in detail below, is configured to slide and move in the horizontal direction.

The hopper unit 2 includes: a placement table 21 on which banknotes are placed; two guide portions 22, 22 that guide the banknotes placed on the placement table 21; a taking-in roller 23; an inlet 24 through which the banknotes are taken in; and a banknote sensor 25 that detects banknotes on the placement table 21. In the present embodiment, banknotes are placed in the hopper unit 2 so as to be taken in a direction parallel to the short edges of the banknotes. As is apparent from FIGS. 1 and 2, the hopper unit 2 is provided so as to project laterally with respect to the first side surface 123. Immediately above the hopper unit 2, the reject stacker 6 is provided so as to protrude laterally from the first side surface 123.

The banknote sensor 25 is disposed near the inlet 24. The banknote sensor 25 has a transmitter unit that emits light and a receiver unit that receives light. When light that is emitted from the transmitter unit and is to arrive at the receiver unit, is blocked, it is detected that the banknote is present. Stacking sensors 52, passage sensors 74, a first tape sensor 9210, and a second tape sensor 9211, which will be described below, each have a similar structure. The banknote sensor 25 is positioned such that light therefrom is blocked by banknotes placed on the placement table 21. That is, the banknote sensor 25 can detect that banknotes are placed on the placement table 21, by the light being blocked.

The dispense unit 11 has a dispense port 111 through which the bundled banknotes are dispensed. In the dispense unit 11, the bundled banknotes are dispensed through the dispense port 111 in the direction parallel to the short edges thereof. The dispense unit 11 has a slanted surface that extends obliquely downward from the dispense port 111. The whole dispense unit 11 including the slanted surface is, as shown in FIGS. 1 and 2, provided so as to protrude laterally from the first side surface 123 with respect to the hopper unit 2.

The first transport unit 7 is composed of transport path forming members 711 to 715 that include a transporting belt and are disposed so as to sandwich each banknote in its thickness direction. The first transport unit 7 has: a main transport path 71; first to fourth diverging paths 72*a* to 72*d* that diverge from the main transport path 71; diverter mechanisms 73 provided at portions at which the diverging paths diverge from the main transport path 71; and a plurality of passage sensors 74 each of which detects that a banknote passes. The first transport unit 7 transports the banknote in the direction parallel to the short edge thereof.

The main transport path 71 extends from the taking-in roller 23 to the first bundling stacker 4A. The first diverging path 72*a* is located at the most upstream side in the main transport path 71, and a second diverging path 72*b*, a third diverging path 72*c*, and a fourth diverging path 72*d* are located in order from the first diverging path 72*a* toward the downstream side. The first to fourth diverging paths 72*a* to 72*d* are, when not distinguished from each other, simply referred to as a diverging path 72. The first diverging path 72*a* extends to the reject stacker 6. The second diverging path 72*b* extends to the second non-bundling stacker 5B. The third diverging path 72*c* extends to the first non-bundling stacker 5A. The fourth diverging path 72*d* extends to the second bundling stacker 4B.

In the first handling unit 126, the transport path forming members include a first transport path forming member 711, a second transport path forming member 712, a third transport path forming member 713, a fourth transport path forming member 714, and a fifth transport path forming member 715 which are arranged in order from the upstream side toward the downstream side. The respective transport path forming members will be described in detail below.

Figure 3:
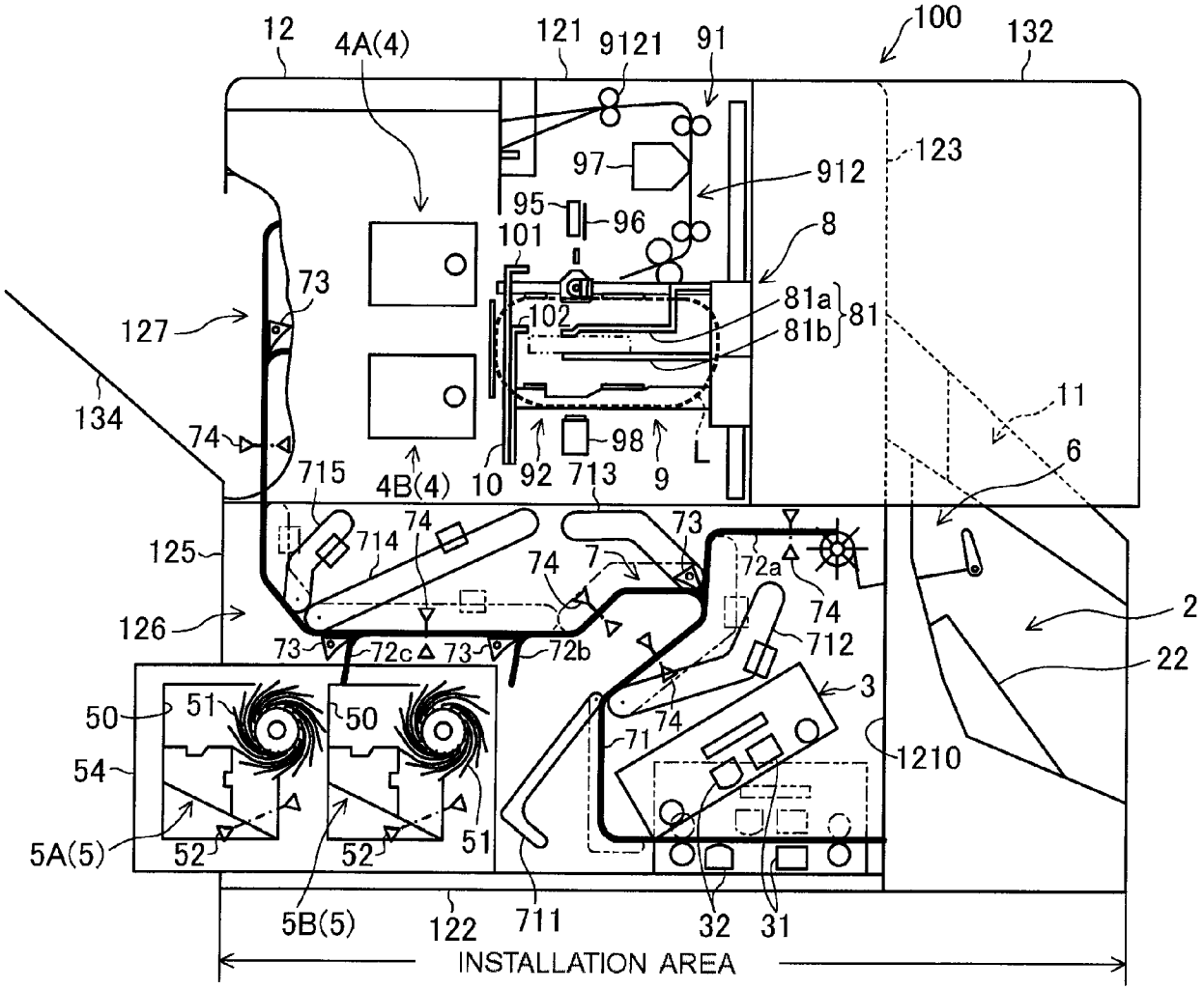
FIG. 3 is a diagram corresponding to FIG. 2, showing a state where transport paths inside the banknote handling apparatus are opened.

The recognition unit 3 is provided upstream of the first diverging path 72*a* in the main transport path 71. The recognition unit 3 is configured to recognize, one by one, the denomination, authenticity, and fitness of each banknote being transported. Specifically, the recognition unit 3 has a line sensor 31 and a magnetic sensor 32, and obtains characteristics of the banknotes. The recognition unit 3 determines whether or not the characteristic of each banknote conforms to the characteristic memorized beforehand, of each kind of banknote, and recognizes the denomination, authenticity, and fitness. The recognition unit 3 is configured such that the banknotes pass through an intermediate position thereof in the up-down direction. As shown in FIG. 3, an upper part, of the recognition unit 3, with respect to the path through which the banknotes are transported is configured to be pivotable upward with one end portion thereof being an axis of the pivoting, so that a jammed banknote can be removed when jamming of banknotes occurs in the recognition unit 3.

The bundling unit 9 bundles stacked banknotes. The bundling unit 9 forms a tape loop L, and winds back the tape after the banknotes have been transported into the tape loop L, to bundle the banknotes with the tape, which will be described below in detail.

The second transport unit 8 holds the banknotes stacked in the bundling stacker 4, and transports the banknotes into the tape loop L. The second transport unit 8 includes: a holding unit 81 that holds banknotes; a first horizontal movement mechanism that moves the holding unit 81 horizontally in the short edge direction of the banknotes (hereinafter, referred to as "first horizontal direction"); a second horizontal movement mechanism that moves the holding unit 81 horizontally in the long edge direction of the banknotes (hereinafter, referred to as "second horizontal direction"); and an up-down movement mechanism that moves the holding unit 81 in the up-down direction.

The holding unit 81 has: an upper arm unit 81*a*; a lower arm unit 81*b* opposing the upper arm unit 81*a*; and a holding mechanism that moves the upper arm unit 81*a* in the up-down direction. The banknotes can be held by the upper arm unit 81*a* and the lower arm unit 81*b*.

The third transport unit 10 transports the bundled banknotes to the dispense portion 11. The third transport unit 10 has an upper holding unit 101, a lower holding unit 102, and a horizontal movement mechanism that moves the upper holding unit 101 and the lower holding unit 102 in the first horizontal direction.

On the second side surface 124 of the housing 12, as shown in FIG. 1, a touch panel 17 is provided. The touch panel 17 is an operation unit through which information is inputted to the banknote handling apparatus 100, and is a display unit that displays information from the banknote handling apparatus 100. The touch panel 17 serves as a human interface part to an operator who operates the banknote handling apparatus 100.

Figure 11:
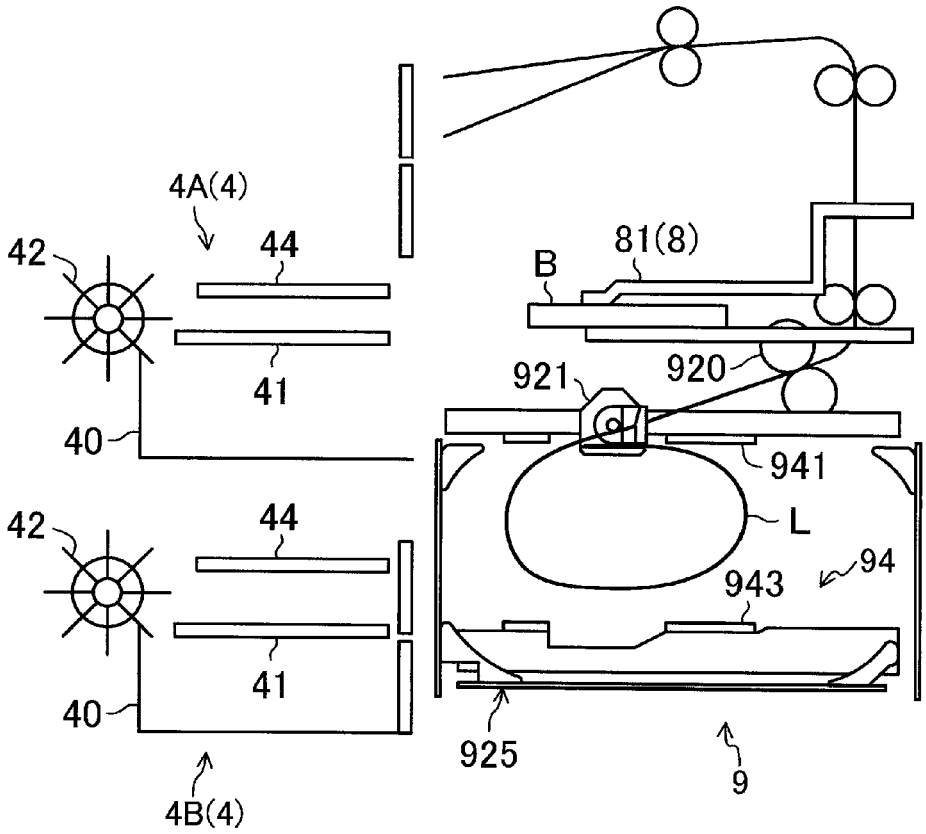
FIG. 11 is a diagram showing a state where banknotes are extracted from a bundling stacker by a second transport unit.
Figure 12:
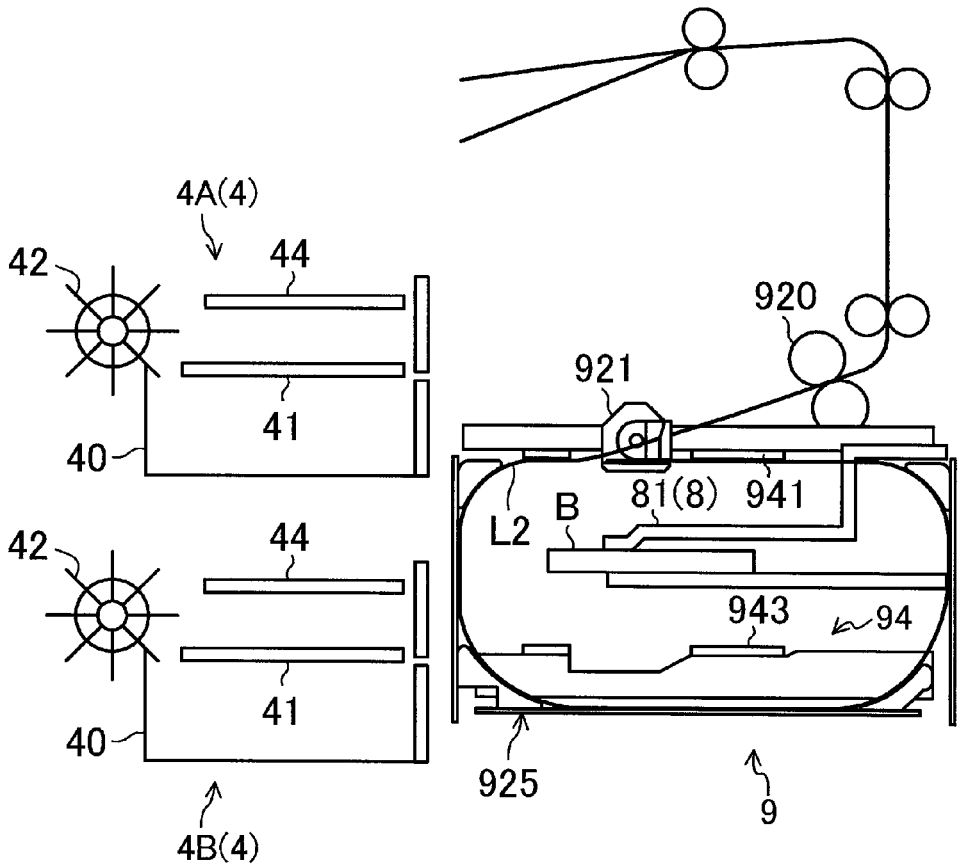
FIG. 12 is a diagram showing a state where the second transport unit has transported the banknotes to a lateral side of a tape loop.

FIGS. 11 and 12 illustrate schematic structures of the bundling stacker 4 and the bundling unit 9.

The bundling stacker 4 stacks banknotes B collectively. The bundling stacker 4 has: a container 40 in which the banknotes B are stacked; a stage 41, disposed in the container 40, on which the banknotes B are placed; a stacking wheel 42 that transports the transported banknotes B into the container 40; a door 43 (see FIG. 1) that opens and closes a first outlet 47 that is open on a side surface of the housing 12; and a top plate 44 that defines the ceiling of the container 40.

Since the first non-bundling stacker 5A and the second non-bundling stacker 5B have the same structure, these stackers will be described as a non-bundling stacker 5 hereinafter without being distinguished.

The non-bundling stacker 5 stacks banknotes collectively. As shown in FIG. 2, the non-bundling stacker 5 has: a container 50 in which the banknotes are stacked; a stacking wheel 51 that transports the transported banknotes into the container 50; and a stacking sensor 52 that detects whether or not a banknote is present.

The container 50 is open on the second side surface 124 of the housing 12. That is, the second side surface 124 is provided with the second outlets 53 through which the banknotes stacked in the non-bundling stacker 5 are taken out from the housing 12. The second outlets 53 are provided in a lower cover 131 described below. When the lower cover 131 is closed, the second outlets 53 communicate with the container 50 (also see FIG. 5). The second outlets 53 have no doors, that is, are opened. At the second side surface 124, the second outlet 53 of the first non-bundling stacker 5A and the second outlet 53 of the second non-bundling stacker 5B are arranged side by side in the horizontal direction.

Figure 5:
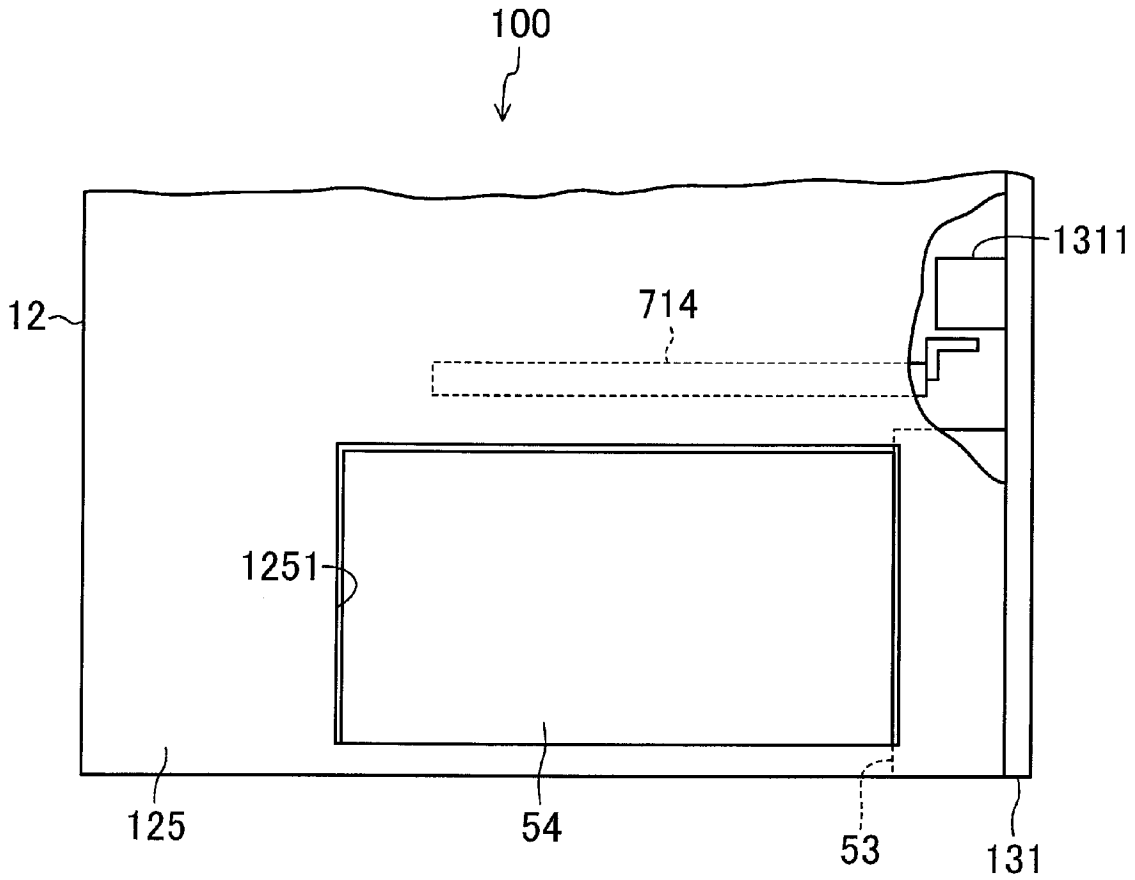
FIG. 5 is a diagram showing a lower part of a third side surface (i.e., left side surface) of the banknote handling apparatus.

The non-bundling stackers 5A and 5B each including the container 50, the stacking wheel 51, and the stacking sensor 52 are integrated to form a single non-bundling stacker module 54. As shown in FIG. 5, in a lower portion of a third side surface 125 (a side surface on the opposite side from the first side surface 123) of the banknote handling apparatus 100, a second opening 1251 different from the opening 1210 of the housing 12 is formed, and a left side surface of the non-bundling stacker module 54 is provided so as to close the second opening 1251. The left side surface of the non-bundling stacker module 54 is substantially flush with the third side surface 125 of the banknote handling apparatus 100. In addition, the non-bundling stacker module 54 is configured to slide and move in the horizontal direction. The non-bundling stacker module 54 is configured to be switched between a normal state in which the non-bundling stacker module 54 is located in a predetermined position and is connected to the second diverging path 72*b* and the third diverging path 72*c* as shown in FIG. 2, and a state in which the non-bundling stacker module 54 is slid and moved leftward, and a portion thereof on the left side protrudes leftward from the housing 12 through the second opening 1251 as shown in FIG. 3. The non-bundling stacker module 54, protruding from the housing 12, is not connected to the second diverging path 72*b* and the third diverging path 72*c*.

<Specific Structure of Bundling Unit 9>

The bundling unit 9 has: a tape feeding unit 91 that feeds a tape T; a tape loop forming unit 92 that forms the tape loop L with the tape T; a clamp unit 94 (see FIG. 7) that presses the banknotes B in the stacking direction when the banknotes B are bundled with the tape T; a heater 95 for joining the tape T in a state where the tape T is wound around the banknotes B; a cutter 96 that cuts the tape T at a position at which the tape T is not wound around the banknotes B; a printing unit 97 that performs printing on the tape T; and a stamping unit 98 that performs stamping on the tape T, as shown in FIG. 2.

Figure 4:
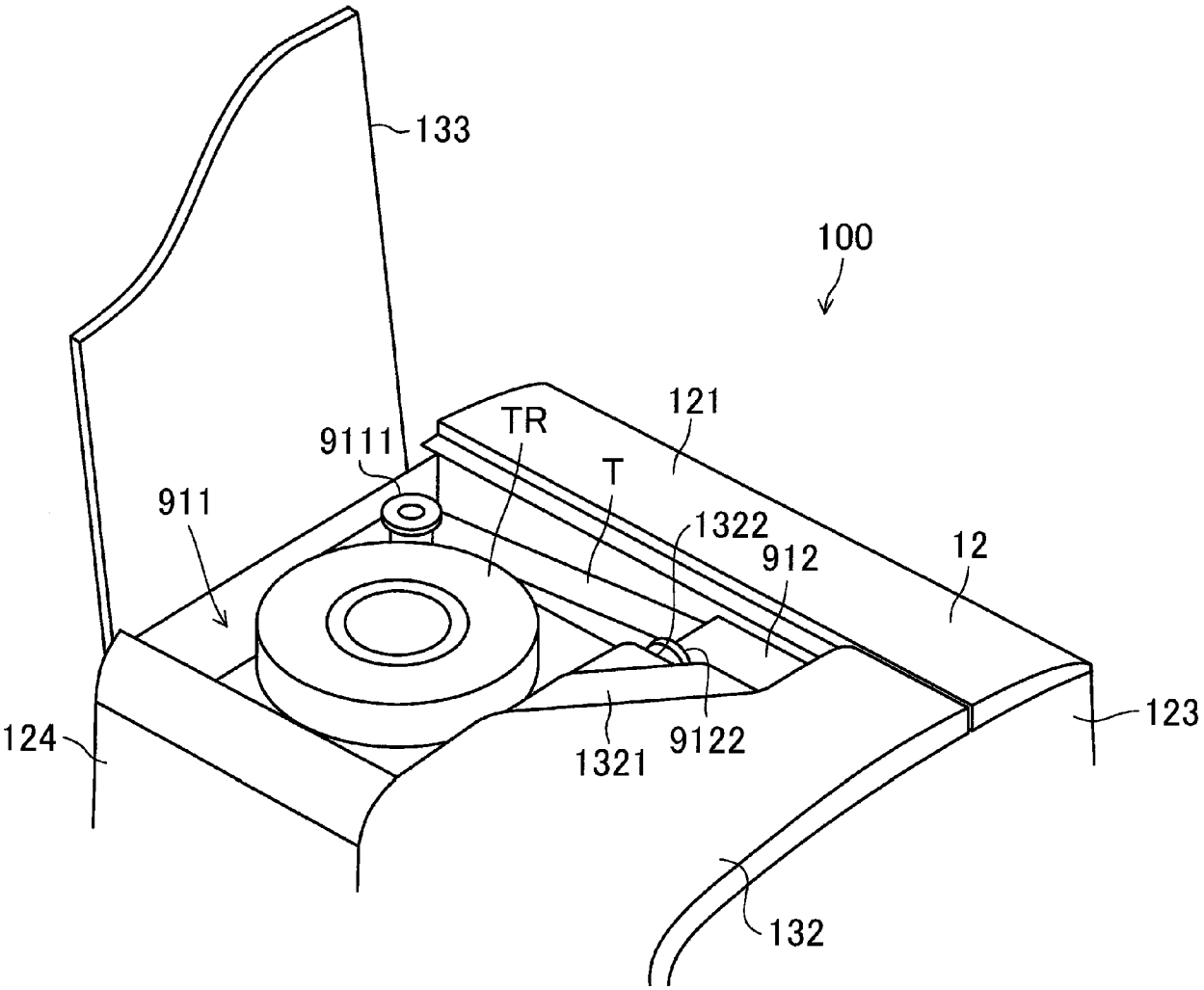
FIG. 4 is a perspective view showing a state where a cover is opened to open a tape housing unit.
Figure 20:
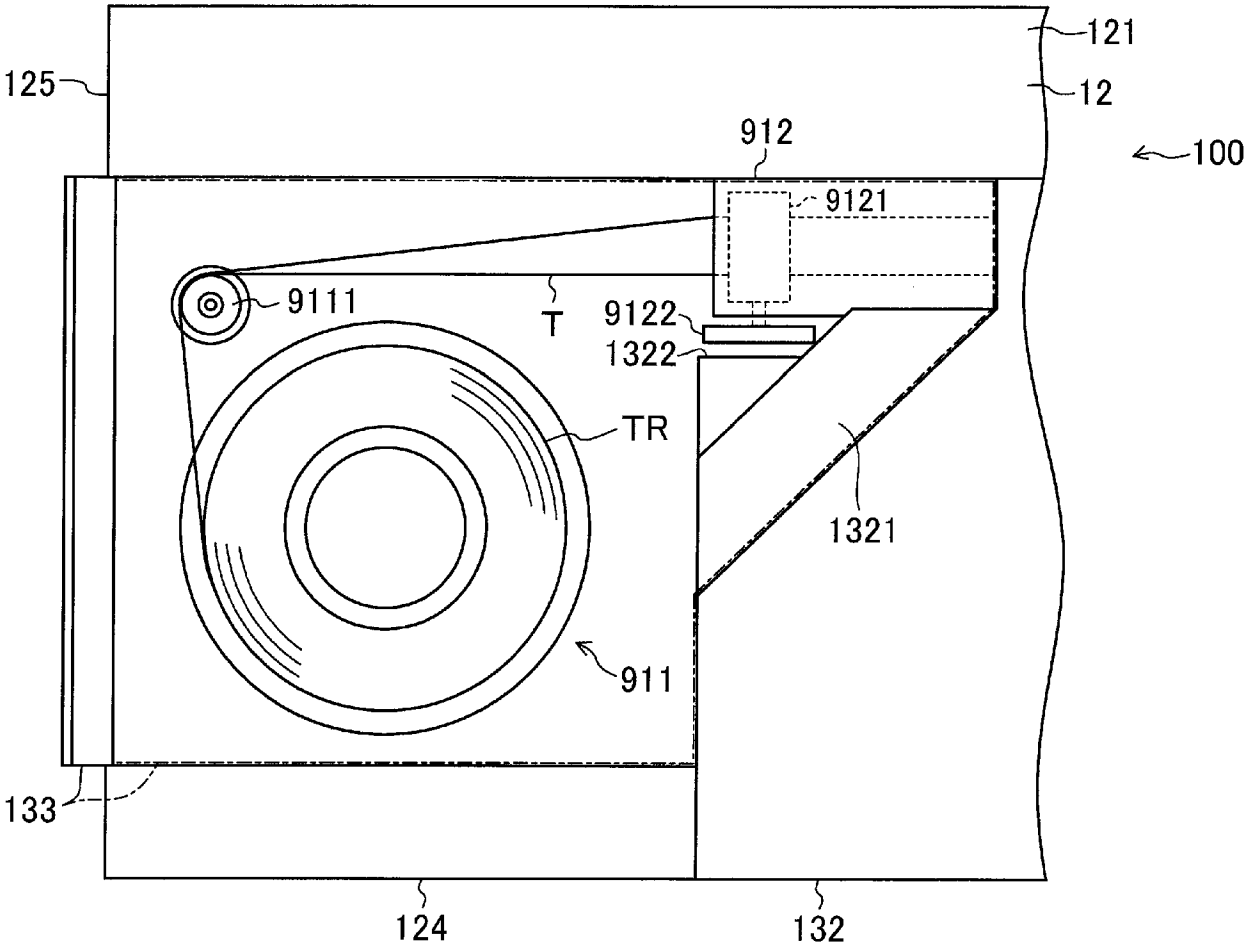
FIG. 20 is a plan view showing a portion of an upper surface of the banknote handling apparatus.

The tape feeding unit 91 has: a roll housing unit 911 in which a tape roll TR having the tape T which is rolled, is set; and a tape transport unit 912 that transports the tape T drawn from the tape roll TR. As shown in FIG. 4, the tape T drawn from the tape roll TR is wound on a change roller 9116, and then transported to the tape transport unit 912. The tape transport unit 912 transports the tape T along a predetermined transport path. The tape transport unit 912 has a guide (not shown) and a plurality of roller pairs. A roller pair 9121 disposed in the tape transport unit 912 at an upstream end in the tape transporting direction is a driving roller. When a new tape roll TR is set in the roll housing unit 911, the leading end of the tape T drawn from the tape roll TR is caused to be tucked into the roller pair 9121. Thus, the tape transport unit 912 can transport the tape T toward the tape loop forming unit 92 until the first tape sensor 9210 (see FIG. 13) detects the leading end of the tape T. In order to cause the leading end of the tape T to be tucked into the roller pair 9121, the roller pair 9121 is provided with an operation unit (operation roller 9122) that makes the roller pair 9121 manually rotatable, as shown in FIG. 20. An operator rotates the operation roller 9122 to rotate the roller pair 9121 so that the leading end of the tape T is tucked into the roller pair 9121.

The tape loop forming unit 92 forms the tape loop L by using the tape T, draws back the tape T after the stacked banknotes B have been positioned in the tape loop L, and winds the tape T around the banknotes B. The tape loop forming unit 92 includes: paired feed rollers 920 that feed and draw back the tape T; a tape holding unit 921 that holds the leading end portion of the tape T; a guide unit 925 that defines the shape of the tape loop L when the tape loop L is formed by using the tape T; the first tape sensor 9210 that detects the leading end of the tape T; and the second tape sensor 9211 that detects that a large tape loop L2 has been formed, as shown in FIGS. 13 to 16. In the tape loop forming unit 92, the tape holding unit 921 forms a small tape loop L1 by using the tape T, and the small tape loop L1 is thereafter enlarged by the tape T being fed by the paired feed rollers 920, to form the large tape loop L2. At this time, the guide unit 925 guides the tape T and defines the shape of the large tape loop L2, and the second tape sensor 9211 detects that the large tape loop L2 has been formed.

The paired feed rollers 920 are driven by a stepping motor, and feeds the tape T when the tape loop L is formed, and also draws back the tape T so as to wind the tape T around the banknotes B after the banknotes B have been positioned in the tape loop L. The paired feed rollers 920 are disposed at a downstream end portion of the tape transport unit 912, and also form a part of the tape transport unit 912. The paired feed rollers 920 represent an example of a feeding unit. The roller pairs of the tape transport unit 912 are also driven via a belt, a gear, or the like by the motor for the paired feed rollers 920.

The first tape sensor 9210 is provided in the transport path for the tape T and between the paired feed rollers 920 and the tape holding unit 921. The first tape sensor 9210 has a structure similar to that of the banknote sensor 25. The first tape sensor 9210 detects the tape T by light being blocked. For example, in the first tape sensor 9210, when the paired feed rollers 920 draw back the tape T and a state where light is blocked shifts to a state where light is received, the leading end of the tape T can be detected.

The tape holding unit 921 is disposed at a position at which the tape T fed from the paired feed rollers 920 can be received. The tape holding unit 921 is configured to be able to hold the tape T and be rotatable while holding the tape T. The tape holding unit 921 rotates while holding the leading end portion of the tape T fed from paired feed rollers 920, thereby forming the tape loop L.

Figure 6A:
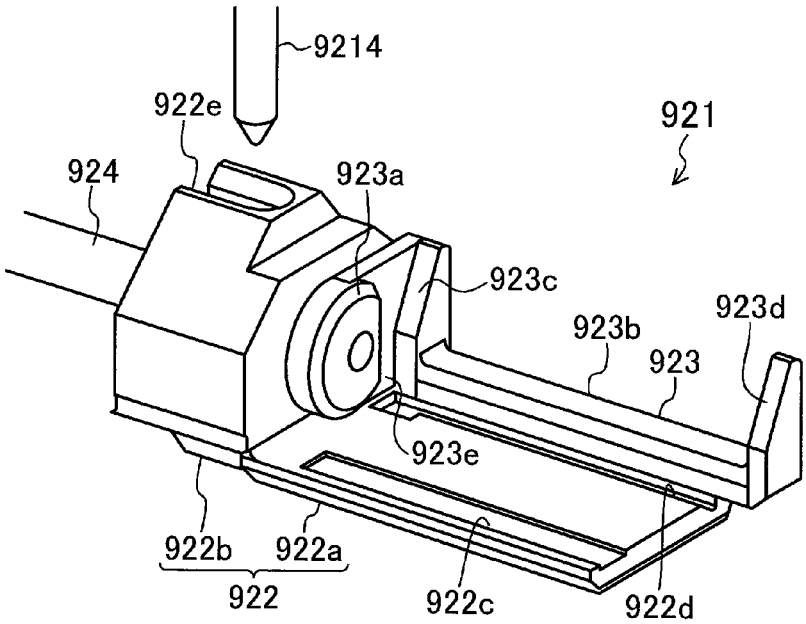
FIG. 6A is a perspective view of a tape holding unit in its closed state.
Figure 6B:
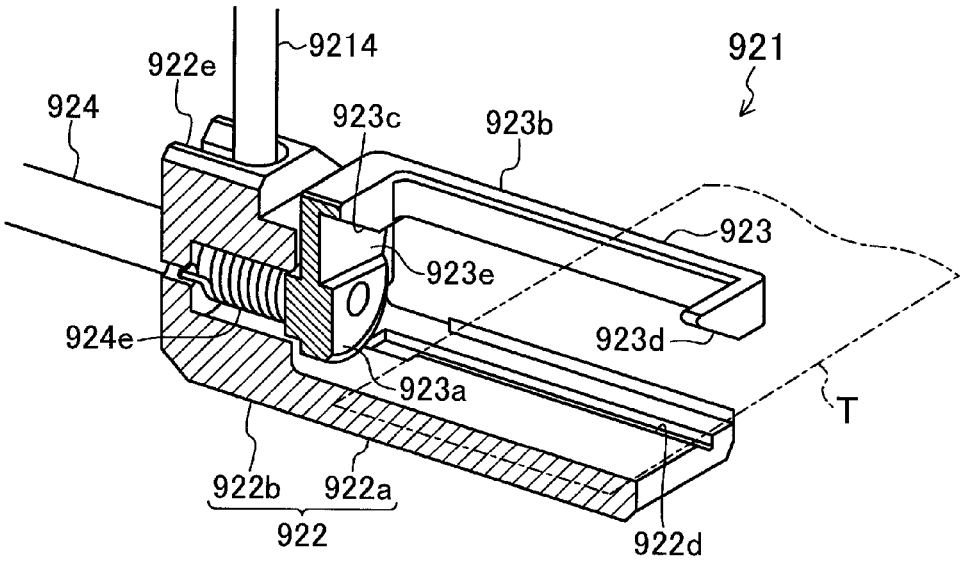
FIG. 6B is a perspective view of the tape holding unit in its open state.

FIG. 6A and FIG. 6B each show a perspective view of the tape holding unit 921. FIG. 6A shows a closed state of the tape holding unit 921 and FIG. 6B shows an open state of the tape holding unit 921. FIG. 6B illustrates the tape holding unit 921, a part of which is cut.

The tape holding unit 921 has a base portion 922, a movable portion 923, and a rotation shaft 924. The base portion 922 has a flat base plate 922*a* and a base block 922*b* integrated with the base plate 922*a*. The base plate 922*a* has first and second recessed grooves 922*c* and 922*d* that extend parallel to each other. The first and second recessed grooves 922*c* and 922*d* extend in the tape width direction. The rotation shaft 924 is inserted into the base block 922*b* so as to be rotatable. Thus, the base portion 922 is supported by the rotation shaft 924 so as to be rotatable, independently of the rotation shaft 924, around the rotation shaft 924 as the center axis. The base block 922*b* also has an engagement portion 922*e* into which a lock pin 9214 described below is inserted, and the engagement portion 922*e* is opened upward.

The rotation shaft 924 extends in the tape width direction, and the rotation shaft 924 is driven to rotate by a not-illustrated stepping motor. The movable portion 923 is disposed so as to oppose the base plate 922*a*, and is fixed to the end of the rotation shaft 924 such that the movable portion 923 cannot rotate relative to the rotation shaft 924. The movable portion 923 is driven to rotate via the rotation shaft 924. The movable portion 923 has: a mounting portion 923*a* mounted at the end of the rotation shaft 924; a pressing portion 923*b* that is mounted in the mounting portion 923*a* so as to be eccentric with respect to the rotation shaft 924 and that extends in parallel to the rotation shaft 924 (that is, in the tape width direction); and first and second guide portions 923*c* and 923*d* provided at both ends of the pressing portion 923*b*. The first guide portion 923*c* forms a guide groove 923*e* between the first guide portion 923*c* and the mounting portion 923*a*.

When the rotation shaft 924 rotates around its own axis in one direction, the movable portion 923 overlaps the base plate 922*a* as shown in FIG. 6A. This state is referred to as a closed state of the tape holding unit 921. Meanwhile, when the rotation shaft 924 rotates around its own axis in the other direction, the movable portion 923 enters a state where a gap is formed between the movable portion 923 and the base plate 922*a* as shown in FIG. 6B. This state is referred to as an open state of the tape holding unit 921. When the tape holding unit 921 is in the open state, the tape T can be inserted between the movable portion 923 and the base plate 922*a* as shown by the dashed line in FIG. 6B. Thereafter, when the tape holding unit 921 enters the closed state, the tape T is held between the movable portion 923 and the base plate 922*a*.

As shown in FIG. 6B, a torsion coil spring 924*e* is mounted around the rotation shaft 924 from the outside thereof. The torsion coil spring 924*e* is mounted inside the base block 922*b* of the base portion 922. One end portion of the torsion coil spring 924*e* engages with the base portion 922. The other end portion of the torsion coil spring 924*e* engages with the mounting portion 923*a* of the movable portion 923, which is not shown in FIG. 6B. The torsion coil spring 924*e* prompts the base portion 922 and the movable portion 923 so as to rotate relative to each other such that the tape holding unit 921 is in the closed state. The movable portion 923 and the base plate 922*a* are maintained so as to overlap each other by rotation prompting force of the torsion coil spring 924*e*.

Figure 19A:
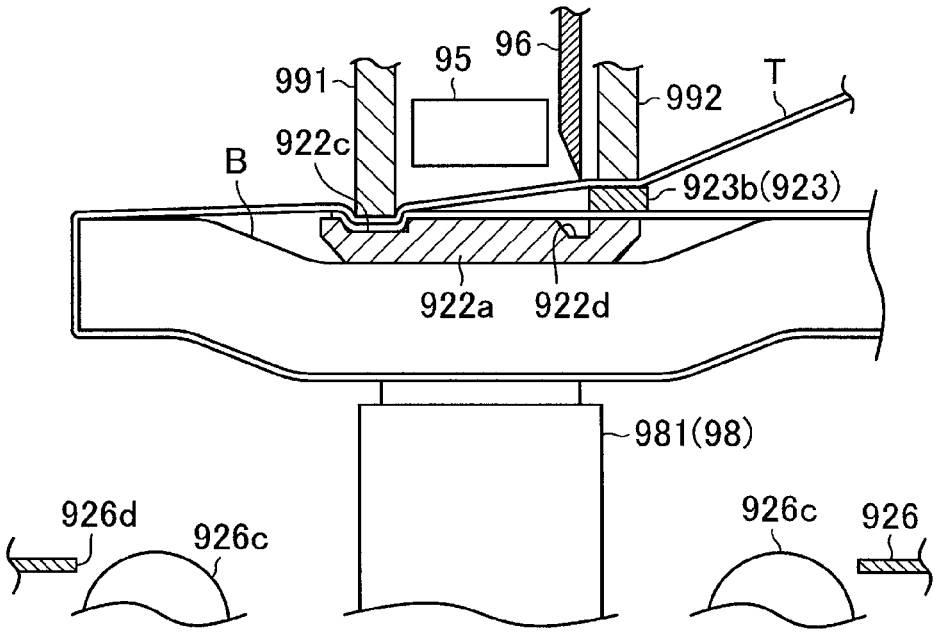
FIG. 19A is a diagram for explaining joining of a tape, cutting thereof, and stamping thereon, showing a state where the tape is pressed by first and second tape pressing portions.
Figure 19B:
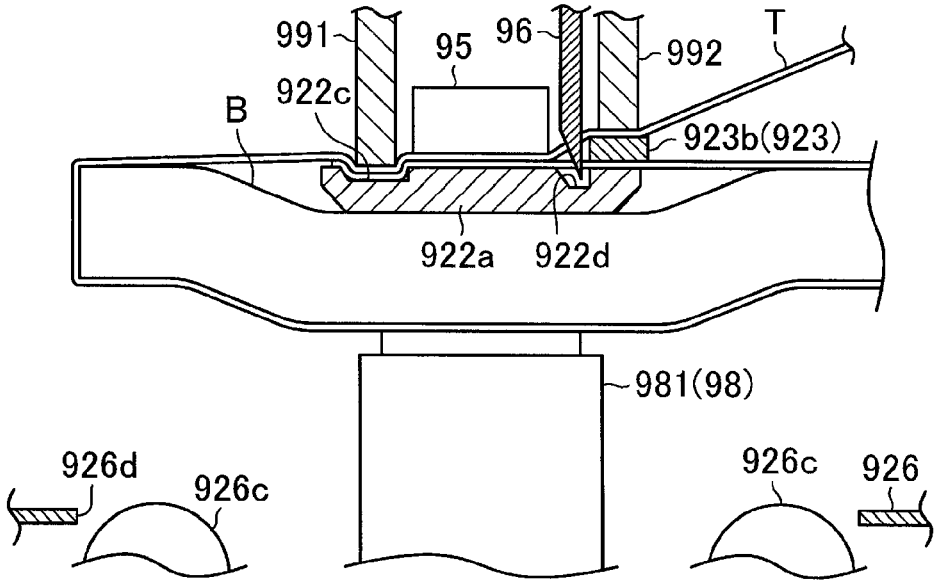
FIG. 19B is a diagram for explaining joining of a tape, cutting thereof, and stamping thereon, showing a state where the tape is melt-adhered by a heater and the tape is cut by a cutter.

In the closed state of the tape holding unit 921, the pressing portion 923*b* of the movable portion 923 overlaps a portion, of the base plate 922*a*, adjacent to the second recessed groove 922*d* (also see FIG. 19A and FIG. 19B). That is, the second recessed groove 922*d* is exposed at a position adjacent to the pressing portion 923*b*. At this time, the first and the second guide portions 923*c*, 923*d* extend in the direction orthogonal to the base plate 922*a*. Similarly, the guide groove 923*e* also extends in the direction orthogonal to the base plate 922*a*.

The lock pin 9214 is disposed vertically above the base block 922*b* so as to be able to reciprocate in the up-down direction. The lock pin 9214 advances into and retracts from the engagement portion 922*e* of the base portion 922. The lock pin 9214 is a round-bar-like member that extends in the up-down direction, and the lower end portion thereof is tapered. The lower end portion of the lock pin 9214 advances into the engagement portion 922*e* provided in the base block 922*b* as described below, and the lower end portion thereof is tapered, whereby the lock pin 9214 easily advances into the engagement portion 922*e*.

As shown in FIG. 6B, when the lock pin 9214 is moved downward, the tapered lower end portion advances into the engagement portion 922*e* provided in the base block 922*b*. This state is a locked state in which the base portion 922 is prevented from rotating. When the stepping motor performs driving in one side direction, as described above, in the locked state, only the movable portion 923 rotates according to rotation of the rotation shaft 924. As a result, the tape holding unit 921 enters the open state. Meanwhile, a state where as shown in FIG. 6A where the lock pin 9214 is moved upward, and the lower end portion of the lock pin 9214 retracts from the engagement portion 922*e*, is an unlocked state in which the base portion 922 is allowed to rotate. When the stepping motor performs driving in the one direction in the unlocked state, the base portion 922 and the movable portion 923 integrally rotate, according to rotation of the rotation shaft 924, by rotation prompting force of the torsion coil spring 924*e*. As a result, when the tape T is inserted in the open state of the tape holding unit, the tape holding unit 921 rotates around the rotation shaft 924 in a state where the tape T is held by the base plate 922*a* and the movable portion 923.

When the large tape loop L2 is formed, the guide unit 925 comes into contact with the outer circumferential surface of the large tape loop L2, and defines the shape of the large tape loop L2. The guide unit 925 defines the large tape loop L2 so as to have an almost rectangular shape, specifically, a rectangular shape in which corner portions are curved.

Figure 7:
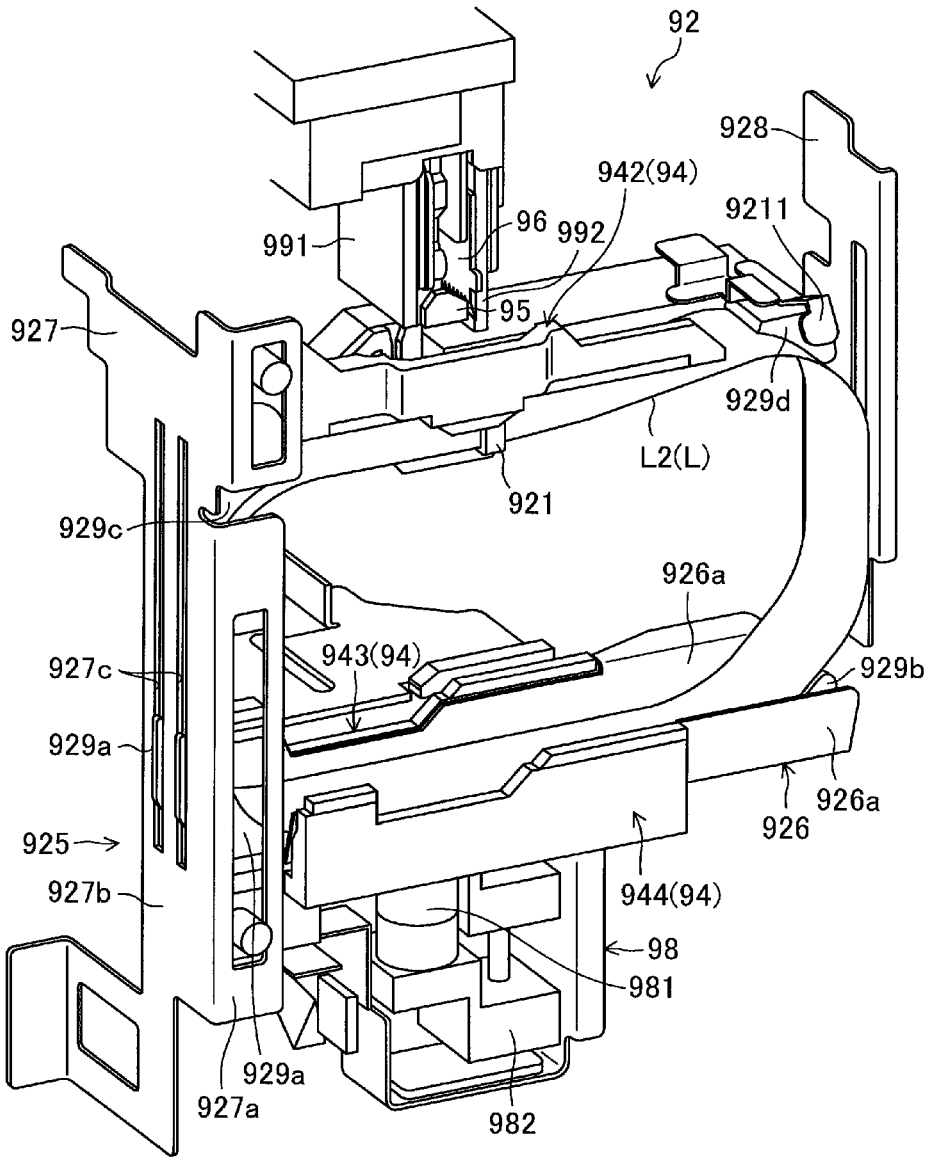
FIG. 7 is a perspective view of a tape loop forming unit.

FIG. 7 is a perspective view of the tape loop forming unit 92. The guide unit 925 has: a lower guide portion 926 that is in contact with the outer circumferential surface of the large tape loop L2 from below the large tape loop L2; a first side guide portion 927 and a second side guide portion 928 that contact the outer circumferential surface of the large tape loop L2 in the horizontal direction; and four corner guide portions, that is, first to fourth corner guide portions 929*a* to 929*d*, corresponding to four corner portions of the rectangular shape.

Figure 8:
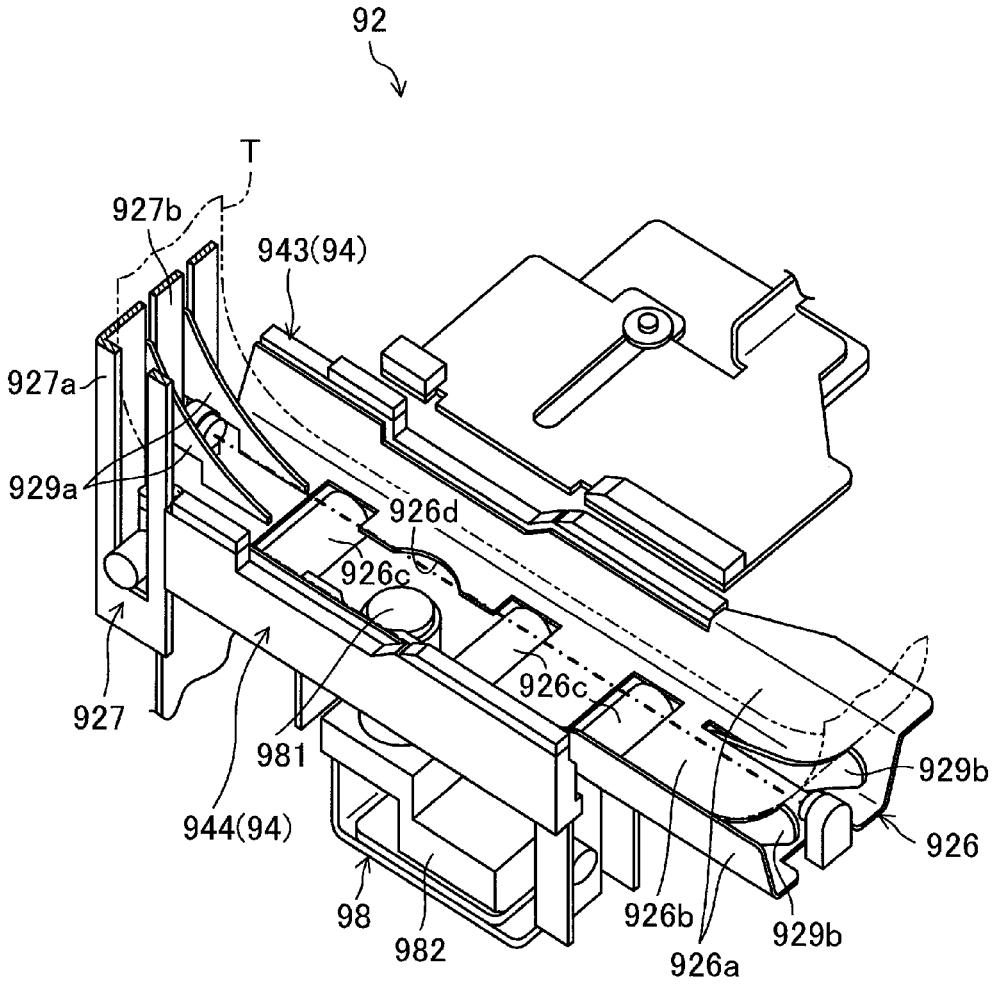
FIG. 8 is a perspective view of a lower part of the tape loop forming unit, as viewed obliquely from above.

FIG. 8 shows a perspective view of the tape loop forming unit 92, in which a lower part of the tape loop forming unit 92 is viewed obliquely from above. The lower guide portion 926 has a pair of side walls 926*a* and 926*a* that restricts the position of the tape T in the width direction, and a bottom wall 926*b*. The lower guide portion 926 is formed in a groove shape. The width of the bottom wall 926*b* is larger than the tape width. The pair of side walls 926*a* and 926*a* are inclined from the bottom wall 926*b* toward the opening end (that is, upward) so that the groove width is increased. The bottom wall 926*b* is provided with a plurality of rollers 926*c*, 926*c*, and the like for improving slidability of the tape T. The bottom wall 926*b* has a through-hole 926*d* through which a stamp 981 of the stamping unit 98 described below, passes.

The first corner guide portion 929*a* and the second corner guide portion 929*b* are provided on both end portions, of the bottom wall 926*b*, in the longitudinal direction. The tape T positioned at the corner portion formed by the lower guide portion 926 and the first side guide portion 927 is curved by the first corner guide portion 929*a*. The tape T positioned at the corner portion formed by the lower guide portion 926 and the second side guide portion 928 (not shown in FIG. 8) is curved by the second corner guide portion 929*b*. The first corner guide portion 929*a* and the second corner guide portion 929*b* each are composed of two plates. The two plates each have an edge curved in a recess shape, and are erected on the bottom wall 926*b* so as to oppose each other.

A movement mechanism is provided for the lower guide portion 926, and the lower guide portion 926 is movable upward and downward by the movement mechanism. The movement mechanism is common between the lower guide portion 926 and lower clamp portions 943 and 944 described below.

The first side guide portion 927 extends in the up-down direction at the end portion, on the bundling stacker 4 side, in the longitudinal direction of the lower guide portion 926, as shown in FIG. 7. The first side guide unit 927 has a side wall 927*a* and a bottom wall 927*b*, and is formed in a groove shape. The side wall 927*a* restricts the position of the tape T in the width direction. The width of the bottom wall 927*b* is larger than the tape width. The bottom wall 927*b* has two slits 927*c* through which the first corner guide portion 929*a* passes (also see FIG. 9).

The second side guide portion 928 extends in the up-down direction at the end portion, on the outlet portion 11 side, in the longitudinal direction of the lower guide portion 926. The second side guide portion 928 is formed in an almost flat-plate shape, and unlike the first side guide unit 927 it does not have a part corresponding to the side wall 927*a*. The second side guide portion 928 is supported by a support unit so as to be movable upward and downward, and connected to the lower guide portion 926 via a link. Thus, the second side guide portion 928 moves upward in conjunction with the upward movement of the lower guide portion 926, and moves downward in conjunction with the downward movement of the lower guide portion 926. A distance over which the second side guide portion 928 moves is amplified by the link. The second side guide portion 928 is configured to retract upward so as not to prevent transporting of the bundled banknotes B when the bundled banknotes B are to be transported.

Figure 9:
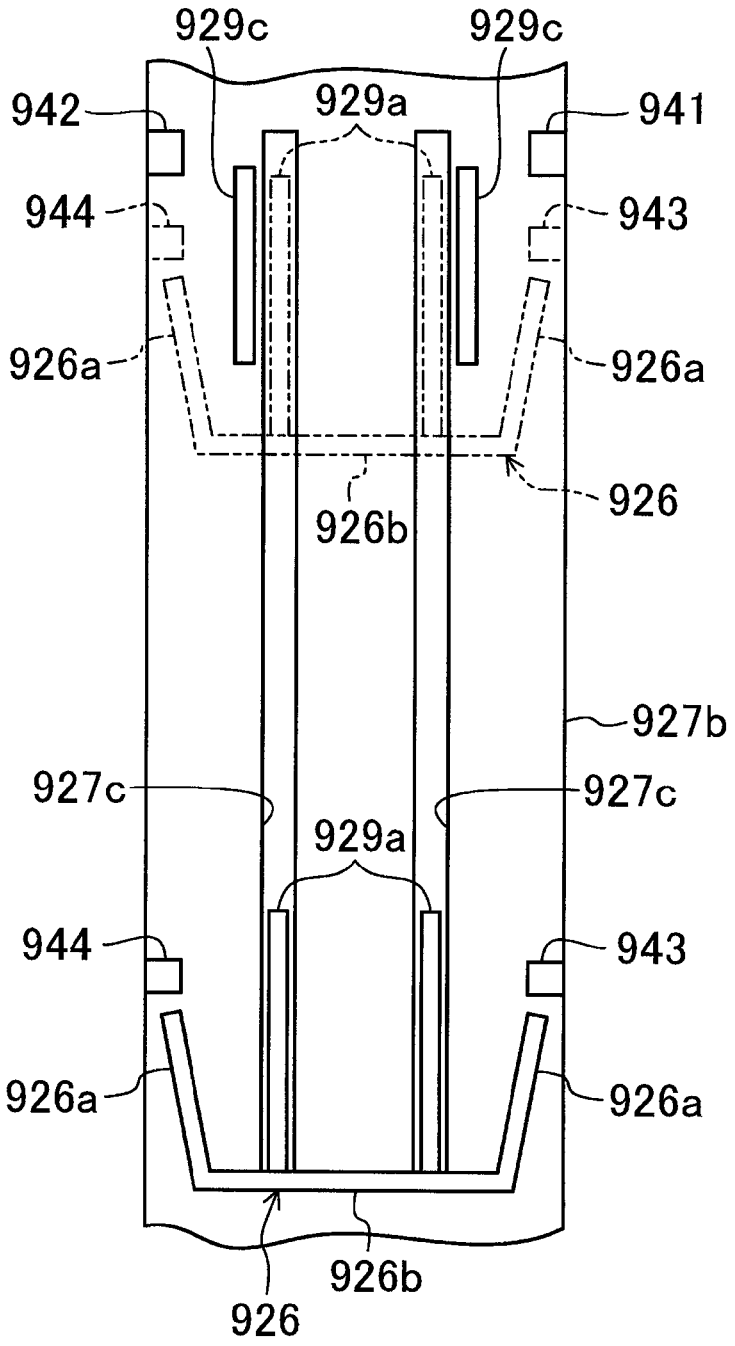
FIG. 9 is a diagram showing a part of the tape loop forming unit, as laterally viewed.
Figure 18:
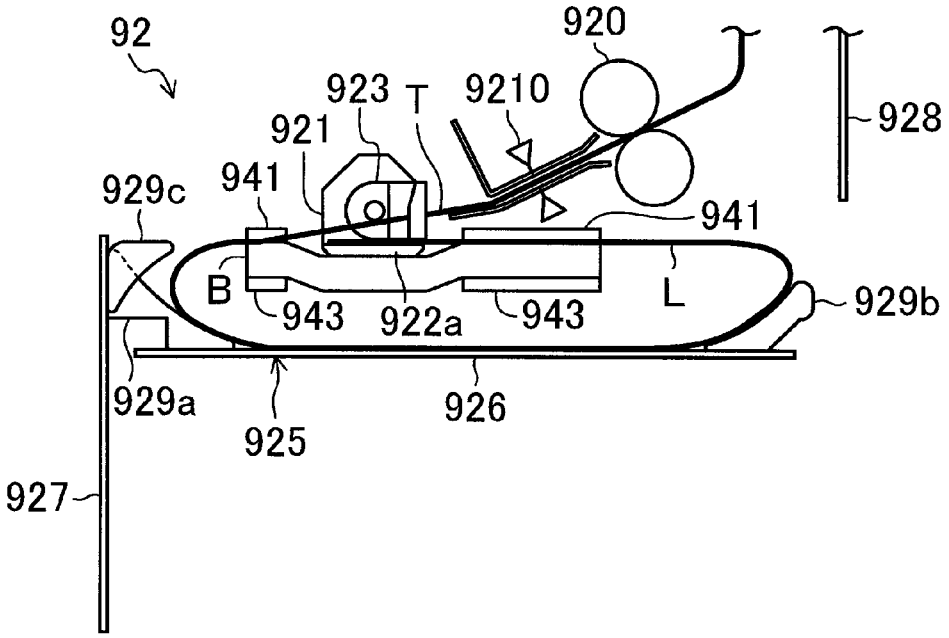
FIG. 18 is a diagram showing a guide unit in a state where the banknotes are pressed by a clamp unit.

The third corner guide portion 929*c* and the fourth corner guide portion 929*d* are provided above the first corner guide portion 929*a* and the second corner guide portion 929*b*, respectively, so as to be almost level with the tape holding unit 921. The third corner guide portion 929*c* is provided adjacent to the first side guide portion 927. The third corner guide portion 929*c* has two plates. The two plates each have an edge curved in a recess shape, and are erected on the bottom wall 927*b* so as to oppose each other. As shown in FIG. 9, the distance between the two plates of the third corner guide portion 929*c* is larger than the distance between the two plates of the first corner guide portion 929*a*. Thus, as shown by an alternate long and two short dashes line in FIG. 9 and as shown in FIG. 18, when the lower guide portion 926 moves upward, the first corner guide portion 929*a* reaches the position at which the first corner guide portion 929*a* overlaps the third corner guide portion 929*c*, but the two plates of the first corner guide portion 929*a* are located between the two plates of the third corner guide portion 929*c*. Thus, the first corner guide portion 929*a* and the third corner guide portion 929*c* do not interfere with each other.

The fourth corner guide portion 929*d* is provided adjacent to the second side guide portion 928. The fourth corner guide portion 929*d* is formed of a block having a surface that curves in a recess shape. Hereinafter, the first to fourth corner guide portions 929*a* to 929*d* are simply referred as a guide unit 929 when not distinguished from each other.

The second tape sensor 9211 has a structure similar to that of the banknote sensor 25, and detects the tape T by light being blocked. The receiver unit of the second tape sensor 9211 is attached to the fourth corner guide portion 929*d* as shown in FIG. 7 and the like. The transmitter unit of the second tape sensor 9211 is positioned such that light from the transmitter unit is blocked by the tape T guided to the fourth corner guide portion 929*d*. That is, when the transmitter unit emits light and the receiver unit does not receive the light, the second tape sensor 9211 detects that the tape T is guided by the fourth corner guide portion 929*d*, that is, that the tape loop L has a predetermined size.

When the banknotes B are bundled by the tape T, the clamp unit 94 presses the banknotes B in the stacking direction. The clamp unit 94 presses a portion, of the banknotes B, near a portion that is to be bundled by the tape T. The clamp unit 94 has: a pair of upper clamp portions 941 and 942 provided above the banknotes B that have been transported into the tape loop L; and a pair of lower clamp portions 943 and 944 provided below the banknotes B, as shown in FIGS. 7 to 9. The upper clamp portions 941 and 942 are provided at the both sides of the tape T in the tape width direction. The lower clamp portions 943 and 944 are provided at the both sides of the tape T in the tape width direction.

The lower clamp portions 943 and 944 are integrated with the lower guide portion 926 of the guide unit 925. That is, the lower clamp portions 943 and 944 and the lower guide portion 926 integrally move upward and downward, as shown in FIG. 9.

The heater 95 allows the tape T to be joined in a state where the tape T is wound around the banknotes B. The heater 95 allows the tape T to be joined by thermal welding. The heater 95 represents an example of a joining unit.

The cutter 96 cuts a portion, of the tape T, which is not wound around the banknotes B, that is, a remaining portion of the tape T that has bundled the banknotes B. The end of the cutter 96 has a saw-teeth-like cutting blade.

As shown in FIG. 7, the heater 95 and the cutter 96 are formed into a unit, and are disposed on a side opposite to the stamping unit 98 side with respect to the banknotes B disposed in the tape loop L, specifically, on a side opposite to the stamping unit 98 side in the direction in which the banknotes B are stacked. More specifically, the heater 95 and the cutter 96 are disposed above the tape holding unit 921. The heater 95 allows the tape T to be joined on the base plate 922*a* of the tape holding unit 921. The cutter 96 cuts the tape T on the base plate 922*a* of the tape holding unit 921.

The printing unit 97 is provided in the tape transport unit 912 as shown in FIG. 2. The printing unit 97 performs printing on the tape T transported by the tape transport unit 912. For example, the printing unit 97 prints, on the tape T, information (for example, denomination, date and time, serial number, and the like) associated with the banknotes B to be bundled. A position on which the printing unit 97 performs printing is displaced in the tape width direction relative to a portion that is to be stamped by the stamping unit 98 such that a portion for the printing by the printing unit 97 does not overlap a portion for stamping by the stamping unit 98.

The stamping unit 98 performs stamping on the tape T in a state where the banknotes B are pressed by the clamp unit 94 and the tape T is wound around the banknotes B. The stamping unit 98 stamps the tape T with, for example, a seal (for example, a seal of a financial facility, or a seal representing a kind of a banknote such as a fit note or an unfit note) associated with the banknotes B to be bundled. The stamping unit 98 is disposed on a side opposite to the heater 95 and the cutter 96 sides with respect to the banknotes B disposed in the tape loop L, specifically, disposed on a side opposite to the heater 95 and the cutter 96 sides in the direction in which the banknotes B are stacked, as shown in FIG. 7. The stamping unit 98 includes the stamp 981, and a movement mechanism 982 for moving the stamp 981 in the up-down direction. When the movement mechanism 982 moves the stamp 981 upward, the stamp 981 is pressed onto the tape T wound around the banknotes B in the direction in which the banknotes B are stacked. The stamping unit 98 is integrated with the lower guide portion 926, and moves upward and downward integrally with the lower guide portion 926 when the lower guide portion 926 moves upward and downward. As shown in FIG. 7, the stamp 981 is disposed between the pair of side walls 926*a* and 926*a* of the lower guide portion 926, in the short side direction of the lower guide portion 926, that is, in the width direction of the tape T. However, in the normal state, the stamp 981 is disposed below the through-hole 926*d* of the bottom wall 926*b* of the lower guide portion 926, and does not protrude upward with respect to the bottom wall 926*b*. When the stamp 981 is moved upward by the movement mechanism 982, the stamp 981 passes through the through-hole 926*d*, and protrudes upward from the bottom wall 926*b*. Thus, the stamp 981 performs stamping on the tape T.

<System Configuration of Banknote Handling Apparatus>

Figure 10:
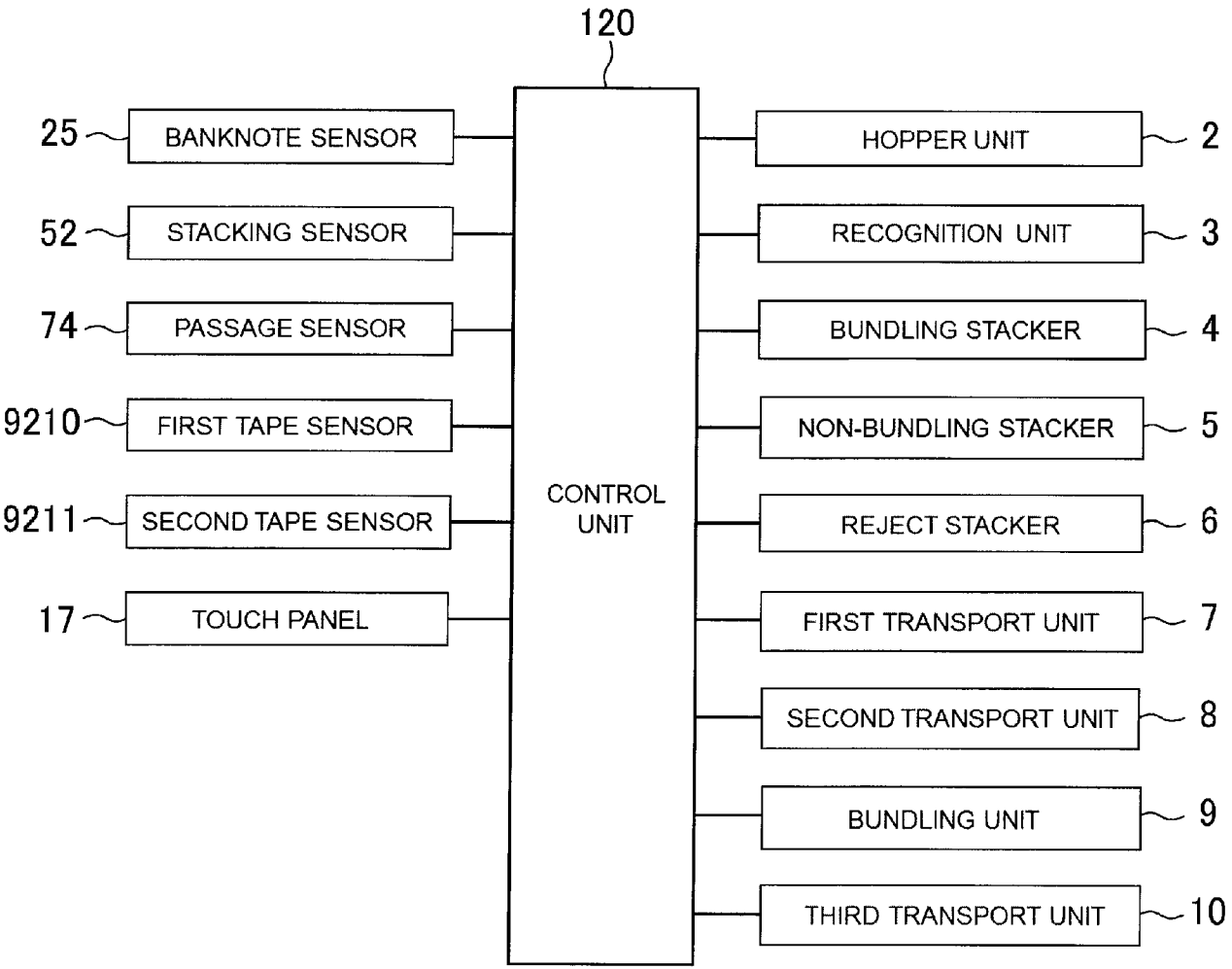
FIG. 10 is a block diagram showing the schematic configuration of the banknote handling apparatus.

FIG. 10 is a block diagram showing a schematic configuration of the banknote handling apparatus 100.

The banknote handling apparatus 100 includes a control unit 120 based on, for example, a well-known microcomputer. The hopper unit 2, the recognition unit 3, the bundling stacker 4, the non-bundling stacker 5, the reject stacker 6, the first transport unit 7, the second transport unit 8, the bundling unit 9, the third transport unit 10, and the touch panel 17, which are described above, are connected to the control unit 120 such that signals can be transmitted and received to the control unit 120. The banknote sensor 25, the passage sensors 74, the first tape sensor 9210, and the second tape sensor 9211 are connected to the control unit 120, and detection signals therefrom are inputted to the control unit 120. The control unit 120 generates control signals on the basis of, for example, an input signal from the touch panel 17 and detection signals from the various sensors, and outputs the control signals to the hopper unit 2 and the like. The hopper unit 2 and the like operate according to the control signals.

<Description for Operation of Banknote Handling Apparatus>

Hereinafter, depositing performed by the banknote handling apparatus 100 will be described. In depositing, loose banknotes are sorted and stacked in predetermined stackers, and further, predetermined banknotes are bundled. Hereinafter, a same-kind-banknote bundling will be described, in which banknotes, of one predetermined kind, to be bundled are stacked by a predetermined number alternately in the first and second bundling stackers 4A and 4B and the predetermined number of stacked banknotes are sequentially bundled by the bundling unit 9.

The banknote handling apparatus 100 is placed on a teller counter, at a position slightly on the left side of an operator (on the right side of a customer) when the operator faces the customer over the teller counter. At this time, the banknote handling apparatus 100 is arranged such that the first side surface 123 of the housing 12 faces the customer. In this state, the second side surface 124 of the housing 12 faces the operator. However, since the banknote handling apparatus 100 is located slightly on the left side of the operator, the customer can also see the second side surface 124.

First, the operator receives loose banknotes to be deposited from the customer, and places the banknotes in the hopper unit 2. At this time, even if the loose banknotes include a plurality of kinds of banknotes, the loose banknotes are just placed in the hopper unit 2 without sorting the loose banknotes. The operator adjusts the guide portions 22 so as to correspond to the dimensions of the banknotes. Subsequently, the operator operates the touch panel 17 and starts taking in the banknotes. When the banknote sensor 25 detects that the banknotes are placed in the hopper unit 2, the banknote handling apparatus 100 may automatically start taking in the banknotes.

The banknotes placed in the hopper unit 2 are taken one by one into the housing 12 through the inlet 24 as the taking-in roller 23 is actuated. The banknotes having been taken in are transported by the first transport unit 7, and pass through the recognition unit 3. The recognition unit 3 recognizes the kind of the passing banknote and notifies the control unit 120 of the kind of the banknote.

The control unit 120 determines, according to the kind of the banknote, a corresponding destination to which the banknote is to be transported. Specifically, when the banknote is a fit banknote, of a predetermined denomination, to be bundled, the control unit 120 determines the bundling stacker 4 (one of 4A or 4B) as the destination. When the banknote is an unfit banknote of the predetermined denomination of a banknote to be bundled, the control unit 120 determines the first non-bundling stacker 5A as the destination. When the banknote is a banknote of a denomination other than the predetermined denomination, the control unit 120 determines the second non-bundling stacker 5B as the destination. When the banknote is a rejected note, the control unit 120 determines the reject stacker 6 as the destination.

The banknotes to be transported to the bundling stacker 4 are transported to one of the two bundling stackers 4. When the number of banknotes stacked in one of the bundling stackers 4 reaches a predetermined number of banknotes to be bundled (for example, 100 banknotes), the subsequent banknotes are transported to the other of the bundling stackers 4. In this example, the banknotes are first transported to the first bundling stacker 4A.

When the number of banknotes stacked in the first bundling stacker 4A reaches the number of banknotes to be bundled, the control unit 120 controls the second transport unit 8 such that the banknotes in the first bundling stacker 4A are held by the holding unit 81, and the banknotes are transported to the bundling unit 9. Thereafter, the control unit 120 controls the bundling unit 9 to bundle the banknotes with the tape T.

When the number of banknotes stacked in the first bundling stacker 4A reaches the number of banknotes to be bundled, the subsequent banknotes are stacked in the second bundling stacker 4B. Thereafter, when the number of the banknotes stacked in the second bundling stacker 4B reaches the number of banknotes to be bundled, the subsequent banknotes are stacked again in the first bundling stacker 4A. By that time, transporting of the banknotes from the first bundling stacker 4A has been completed, and the first bundling stacker 4A is empty. Thus, since the two bundling stackers 4 are provided, bundling can be performed while banknotes are continuously stacked.

Subsequently, the control unit 120 controls the third transport unit 10 to dispense the bundled banknotes through the dispense port 111.

An unfit banknote of the predetermined denomination is transported into the first non-bundling stacker 5A. Thus, the unfit banknote of the predetermined denomination is stacked in the first non-bundling stacker 5A. Likewise, banknotes of denominations other than the predetermined denomination are transported into the second non-bundling stacker 5B, and stacked in the second non-bundling stacker 5B. Similarly, a rejected note is transported into the reject stacker 6 and stacked in the reject stacker 6.

The above-described handling is continuously performed until the banknotes placed in the hopper unit 2 have been all taken in. The banknote sensor 25 detects whether or not banknote(s) is present in the hopper unit 2.

When the handling of the banknotes placed in the hopper unit 2 has been completed, taking-in and recognition of the rejected note are performed again. That is, the operator extracts the rejected note from the reject stacker 6 and places the rejected note in the hopper unit 2, and taking-in of the rejected note is performed again. The rejected note is a banknote which is not recognized as a normal banknote for some reason. Therefore, taking-in and recognition thereof are attempted again. The banknote still recognized as a rejected note is stacked in the reject stacker 6 again. The operator returns the banknote stacked again to the customer.

Taking-in of the banknotes stacked in the first and second non-bundling stackers 5A and 5B is not performed again.

When the handling of banknotes placed in the hopper unit 2 and the re-handling of the rejected note(s) have been completed, the same-kind-banknote bundling is completed, and counting and sorting of the banknotes that have been handed in by the customer to be deposited, are ended. On the touch panel 17, the counted monetary amount is displayed. The operator receives an approval of the monetary amount from the customer, or confirms that the monetary amount is equal to the monetary amount written by the customer on the deposit slip, and performs a confirmation operation for the deposited monetary amount by using the touch panel 17. When the confirmation operation has been performed, a higher-ranking device (not shown) is notified of the confirmed deposited monetary amount, thereby completing the deposit.

After the deposit has been completed, the operator takes out the bundled banknotes dispensed in the dispense unit 11, the banknotes stacked in the bundling stacker 4, and the banknotes stacked in the non-bundling stacker 5, and stores the banknotes in a predetermined storage place.

In the above-described handling, the loose banknotes including a plurality of kinds of banknotes are sorted into fit notes of the predetermined denomination, unfit notes of the predetermined denomination, banknotes of denominations other than the predetermined denomination, and rejected notes, and the fit notes of the predetermined denomination are bundled in units of the number of banknotes to be bundled.

<Detailed Description for Handling after Stacking>

Hereinafter, handling, from a state of banknotes having been stacked in the bundling stacker 4, to dispensing thereof into the dispense unit 11, will be described in detail.

—Transporting of Banknotes to Bundling Unit—

When stacking of the banknotes B has been completed, the second transport unit 8 transports the banknotes B from the bundling stacker 4 to the bundling unit 9. FIG. 11 illustrates a state where the banknotes B are extracted from the bundling stacker 4 by the second transport unit 8. FIG. 12 illustrates a state where the second transport unit 8 has transported the banknotes B to a lateral side of the tape loop L.

Specifically, when stacking of the banknotes B has been completed, the second transport unit 8 moves to the bundling stacker 4 at which the stacking of the banknotes B has been completed, holds the banknotes B in the bundling stacker 4, and extracts the banknotes B from the bundling stacker 4 as shown in FIG. 11.

Subsequently, the second transport unit 8 moves the banknotes B to a predetermined second position in the up-down direction as shown in FIG. 12. The second position is a position at which the banknotes B are transported into the large tape loop L2. At the second position, the banknotes B are positioned near the center portion of the large tape loop L2 as viewed in the long edge direction of the banknotes B.

—Forming of Tape Loop—

Figure 13:
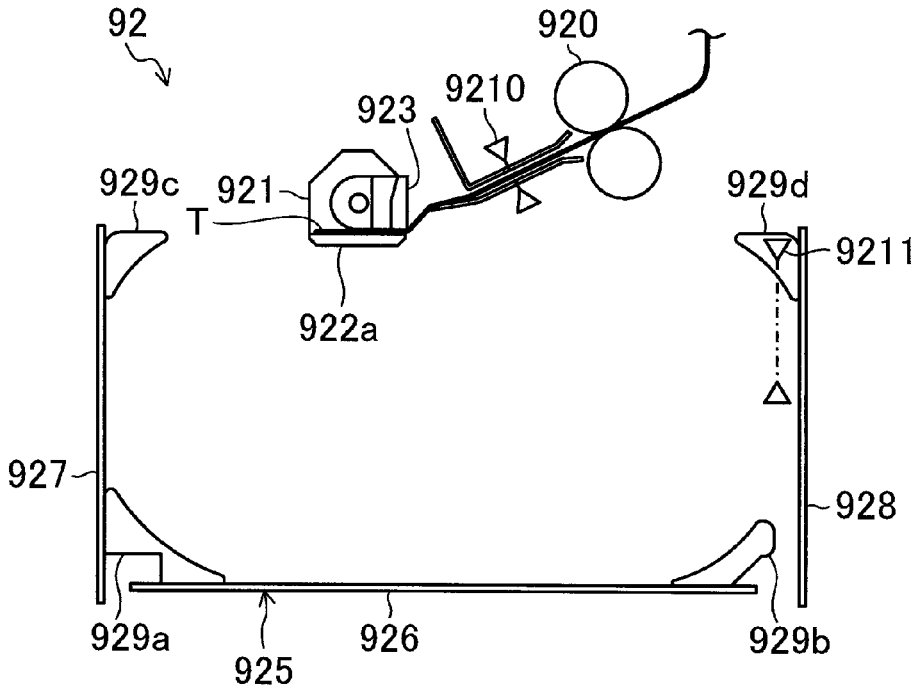
FIG. 13 is a diagram showing a state where the tape holding unit holds a leading end portion of the tape.
Figure 14:
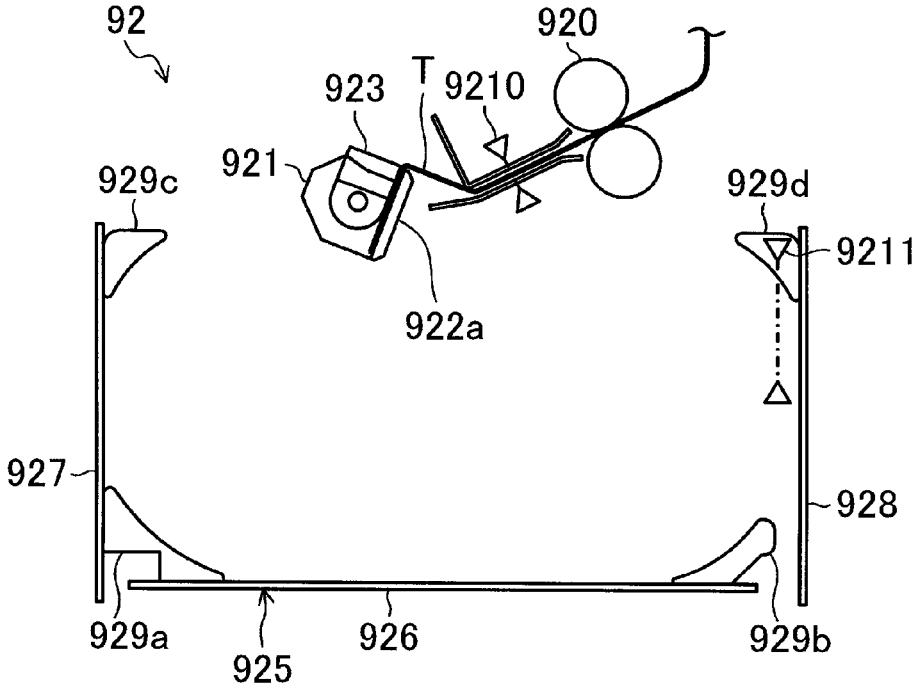
FIG. 14 is a diagram showing a state where the tape holding unit starts rotating while holding the leading end portion of the tape.
Figure 15:
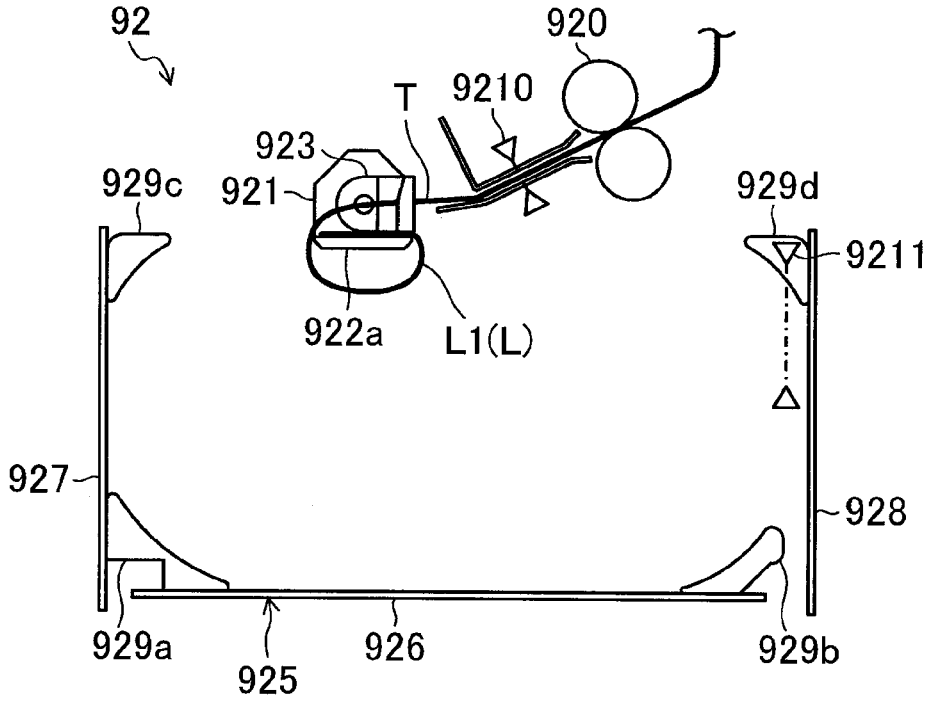
FIG. 15 is a diagram showing a state where the tape holding unit has formed a small tape loop.
Figure 16:
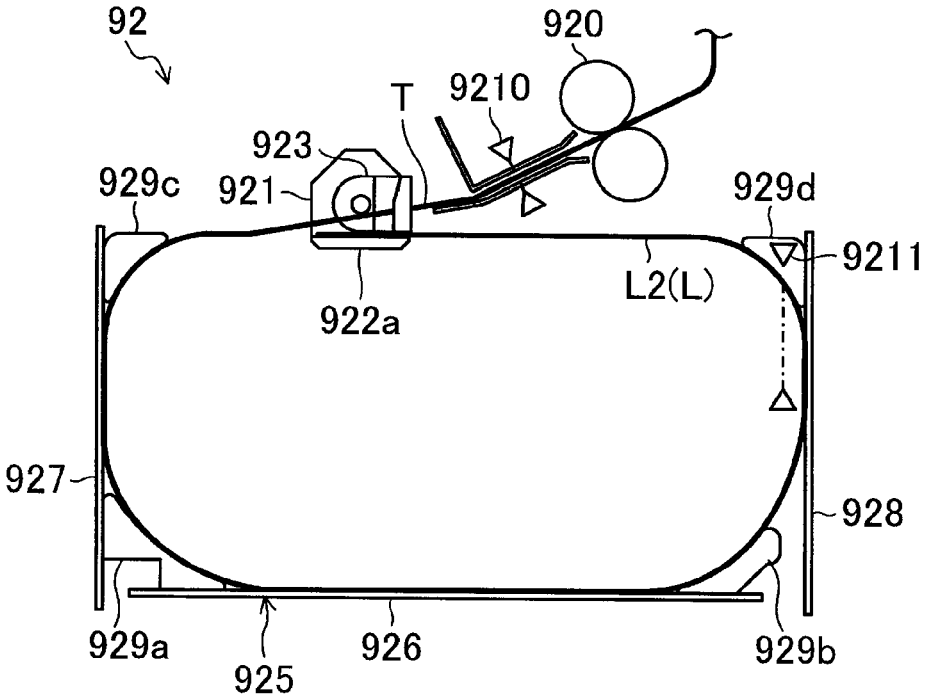
FIG. 16 is a diagram showing a state where a large tape loop is formed.

The control unit 120 forms the large tape loop L2 while the second transport unit 8 transports the banknotes B from the bundling stacker 4 to the second position. FIG. 13 illustrates a state where the tape holding unit 921 holds the leading end portion of the tape T. FIG. 14 illustrates a state where the tape holding unit 921 starts rotating while holding the leading end portion of the tape T. FIG. 15 illustrates a state where the tape holding unit 921 has formed the small tape loop L1. FIG. 16 illustrates a state where forming of the large tape loop L2 has been completed.

First, the paired feed rollers 920 draws back the tape T until the first tape sensor 9210 detects the leading end of the tape T. When the leading end of the tape T has been detected, the paired feed rollers 920 feed the tape T. At this time, the lock pin 9214 causes the base portion 922 to be in the locked state, and a stepping motor 9212 is driven in one side direction, whereby the tape holding unit 921 is oriented in a stand-by state in which a gap is formed between the movable portion 923 and the base plate 922*a*, and the tape T fed from the paired feed rollers 920 is inserted into the gap (also see FIG. 6B). When the tape T is fed by the paired feed rollers 920 by an amount that allows the leading end portion of the tape T to be inserted between the movable portion 923 and the base plate 922*a*, the rotation shaft 924 is driven to rotate, and the leading end portion of the tape T is held by the movable portion 923 and the base plate 922*a*, as shown in FIG. 13 (also see FIG. 6A). Both the movable portion 923 and the base plate 922*a* hold the leading end portion of the tape T due to rotation prompting force of the torsion coil spring 924*e*. The leading end portion of the tape T is held by the tape holding unit 921 in a state where the leading end portion is almost horizontally oriented.

The printing unit 97 performs printing on the tape T in parallel with feeding of the tape T by the paired feed rollers 920.

Subsequently, the lock pin 9214 causes the base portion 922 to be in the unlocked state, and the stepping motor 9212 is driven in the one direction, whereby the tape holding unit 921 starts rotating in a state where the leading end portion of the tape T is held due to rotation prompting force of the torsion coil spring 924*e*, as shown in FIG. 14. At this time, the tape T continues to be fed by the paired feed rollers 920. The tape holding unit 921 rotates so as to move the leading end of the tape T downward, that is, rotates counterclockwise in FIG. 14.

When the tape holding unit 921 has performed almost one rotation, the tape loop L is formed as shown in FIG. 15. The tape loop L which is thus formed by the tape holding unit 921 performing almost one rotation is referred to as "small tape loop L1". The leading end portion of the tape T held by the tape holding unit 921 is positioned at the upper portion of the small tape loop L1, and the small tape loop L1 is formed below the tape holding unit 921. Further, the small tape loop L1 is formed at a position lower than the paired feed rollers 920.

When the small tape loop L1 has been formed, the tape holding unit 921 stops rotating, and the tape T continues to be fed by the paired feed rollers 920. As a result, the small tape loop L1 is gradually enlarged. The leading end portion of the tape T held by the tape holding unit 921 is positioned at the upper portion of the small tape loop L1, and the tape T is fed by the paired feed rollers 920 from the upper portion of the small tape loop L1, whereby the small tape loop L1 is expanded downward. Below the tape holding unit 921, the guide unit 925 is disposed, whereby the tape loop L comes into contact with the guide unit 925 in due course, and the shape of the tape loop L is defined by the guide unit 925. When the amount of the tape T that has been fed from the paired feed rollers 920 finally reaches a predetermined amount, the tape loop L is formed so as to have an almost rectangular shape by the guide unit 925, as shown in FIG.

16. This tape loop L is referred to as a "large tape loop L2.". The large tape loop L2 is in contact with the lower guide portion 926, the first side guide portion 927, and the second side guide portion 928, and is formed into an almost rectangular shape. In addition, the large tape loop L2 is in contact with the first to fourth corner guide portions 929*a* to 929*d*, whereby the large tape loop L2 is formed into a rectangular shape in which the corner portions are curved.

When the amount of the tape T that has been fed from the paired feed rollers 920 has become the predetermined amount, the control unit 120 detects that the large tape loop L2 has been formed according to the second tape sensor 9211 detecting the tape T.

The second tape sensor 9211 is configured to detect the tape T guided to the fourth corner guide portion 929*d*. That is, when the banknotes B are transported into the large tape loop L2, the second tape sensor 9211 detects whether or not the tape T is present at a predetermined position above the banknotes B. If a part of the tape loop L bends inward, the upper portion of the tape loop L is likely to bend due to the weight of the tape T itself. That is, disposing the second tape sensor 9211 at the above-described position enables the second tape sensor 9211 to accurately detect bending of the tape loop L.

The large tape loop L2 is formed, as shown in FIGS. 11 and 12, in parallel with an operation, performed by the second transport unit 8, of transporting the banknotes B from the bundling stacker 4 to the bundling unit 9. In general (that is, in a case where the large tape loop L2 is formed by feeding of the tape T being performed once), when the banknotes B have been transported to the second position, forming of the large tape loop L2 has been completed.

—Winding of Tape—

Figure 17A:
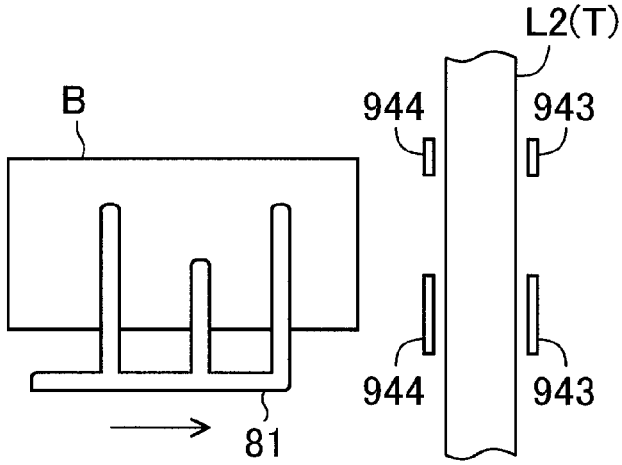
FIG. 17A is a diagram for explaining the operations of respective parts until the banknotes are transported into the large tape loop, as viewed in a direction of the thickness of the banknotes, and showing a state immediately before the banknotes are transported into the large tape loop.
Figure 17B:
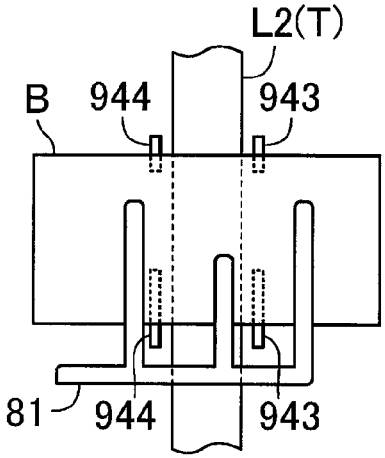
FIG. 17B is a diagram for explaining the operations of respective parts until the banknotes are transported into the large tape loop, as viewed in the direction of the thickness of the banknotes, and showing a state where the banknotes have been transported into the large tape loop.
Figure 17C:
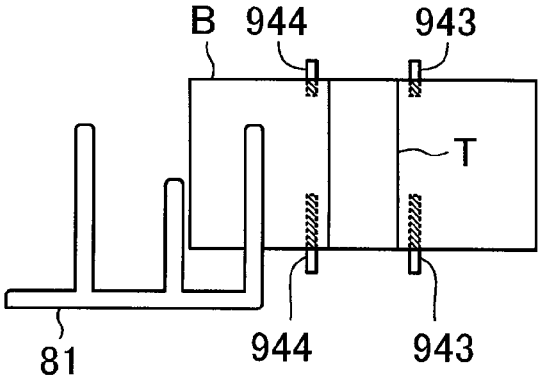
FIG. 17C is a diagram for explaining the operations of respective parts until the banknotes are transported into the large tape loop, as viewed in the direction of the thickness of the banknotes, and showing a state where the tape has been wound around the banknotes.

FIGS. 17A to 17C illustrate an operation, performed by each component, from transporting of the banknotes B into the large tape loop L2 to winding of the tape T around the banknotes B, as viewed in the thickness direction of the banknotes B. In FIG. 17, FIG. 17A illustrates a state immediately before the banknotes B are transported into the large tape loop L2, FIG. 17B illustrates a state where the banknotes B have been transported into the large tape loop L2, and FIG. 17C illustrates a state where the tape T has been wound around the banknotes B. FIG. 18 illustrates the guide unit 925 in a state where the banknotes B are pressed by the clamp unit 94. In FIGS. 17A to 17C, the upper clamp portions 941 and 942 are not shown. Further, in FIG. 17, portions, of the lower clamp portions 943 and 944, which are in contact with the banknotes B are indicated by hatching.

The second transport unit 8 transports the banknotes B to the second position as described above, as shown in FIGS. 11 and 12 (see FIG. 17A), and the banknotes B are thereafter moved, in the second horizontal direction, into the large tape loop L2. The holding unit 81 of the second transport unit 8 moves the banknotes B to a predetermined third position in the second horizontal direction, as shown in FIG. 17B. At the third position, in the second horizontal direction, the tape T is positioned at almost the center of the banknotes B in the long edge direction.

The banknotes B are transported to the third position, and the holding unit 81 holds again a portion of the banknotes B other than a portion thereof which is to be bundled (a portion around which the tape T is wound in the subsequent handling). Thereafter, the clamp unit 94 presses the banknotes B from both sides in the stacking direction, that is, in the up-down direction. In the up-down direction, the upper clamp portions 941 and 942 and the lower clamp portions 943 and 944 hold the both sides, in the long edge direction of the banknotes B, of the portion of the banknotes B which is to be bundled. Thus, the banknotes B are pressed by the upper clamp portions 941 and 942 and the lower clamp portions 943 and 944 in the up-down direction.

The lower clamp portions 943 and 944 are integrated with the lower guide portion 926, whereby the lower guide portion 926 also moves upward according to the lower clamp portions 943 and 944 moving upward. At this time, the paired feed rollers 920 draw back the tape T according to the lower guide portion 926 moving upward. As a result, as shown in FIG. 18, the tape loop L is reduced in size according to the lower guide portion 926 moving upward. In addition, the second side guide portion 928 also moves upward according to the lower guide portion 926 moving upward. Thus, a space in which the tape loop L can be deformed, can be provided. That is, when a rate at which the lower guide portion 926 moves upward is too high as compared to a rate at which the tape loop L is reduced in size, the tape loop L is deformed so as to extend beyond the guide unit 925. At this time, the second side guide portion 928 has been retracted from the lateral side of the tape loop L, and therefore, the tape loop L can expand into a space in which the second side guide portion 928 was positioned. Thus, bending of the tape T can be prevented.

Upward movement of the lower guide portion 926 is stopped together with the upward movement of the lower clamp portions 943 and 944. Meanwhile, the tape T continues to be drawn back by the paired feed rollers 920 also after upward movement of the lower guide portion 926 is stopped. As shown in FIG. 17C, the tape T is finally wound around the banknotes B.

—Joining of Tape, Cutting Thereof, and Stamping Thereon—

Subsequently, the tape T is joined by the heater 95 and the tape T is cut by the cutter 96. In addition, the stamping unit 98 performs stamping on the tape T. FIG. 19A and FIG. 19B illustrate joining of the tape T, cutting thereof, and stamping thereon. Specifically, FIG. 19A illustrates a state where the tape is pressed by first and second tape pressing portions, and FIG. 19B illustrates a state where the tape is melt-adhered by the heater and the tape is cut by the cutter.

When winding of the tape T around the banknotes B has been completed, the heater 95 and the cutter 96 move downward together. At this time, first and second tape pressing portions 991 and 992 also move downward together with the heater 95 and the cutter 96.

First, as shown in FIG. 19A, the first tape pressing portion 991 fits into the first recessed groove 922*c* of the base plate 922*a*, and sandwiches the tape T between the first tape pressing portion 991 and a bottom wall of the first recessed groove 922*c*. At the same time, the second tape pressing portion 992 sandwiches the tape T between the second tape pressing portion 992 and the upper surface of the pressing portion 923*b* of the movable portion 923. At this time, melt-adhesion by the heater 95 and cutting by the cutter 96 are not performed.

Subsequently, as shown in FIG. 19B, the heater 95 sandwiches a portion, of the tape T, in which the leading end portion of the tape T overlaps the tape T that has been wound once, between the heater 95 and the base plate 922*a* of the tape holding unit 921. Specifically, the heater 95 sandwiches the tape T between the heater 95 and a portion of the base plate 922*a* which is positioned between the first recessed groove 922*c* and the second recessed groove 922*d*. The heater 95 melt-adheres an overlap portion of the tape T by heat.

The tape T is cut by the cutter 96 in parallel with melt-adhesion by the heater 95 due to heat. The cutter 96 cuts a portion, of the tape T, which is upstream of the portion melt-adhered by the heater 95, that is, a portion (hereinafter, referred to as a "remaining portion") not on the melt-adhered portion side but on the paired feed rollers 920 side. The cutter 96 is guided by the first and second guide portions 923*c* and 923*d* into the second recessed groove 922*d*. Thus, the tape T wound around the banknotes B is joined, and the remaining portion of the tape T is cut.

When joining and cutting of the tape T have been completed, the heater 95, the cutter 96, the first tape pressing portion 991, and the second tape pressing portion 992 move upward.

The stamping unit 98 performs stamping on the tape T in parallel with the melt-adhesion by the heater 95 and the cutting by the cutter 96. The stamping unit 98 has moved upward together with the lower guide portion 926, and is positioned vertically below the banknotes B when melt-adhesion and cutting of the tape T are performed. After the tape T is drawn back by the paired feed rollers 920 and wound around the banknotes B, the stamping unit 98 moves the stamp 981 upward. The stamp 981 comes into contact with the tape T wound around the banknotes B and performs stamping on the tape T.

—Discharge of Banknotes—

The banknotes B bundled with the tape T are transported to the dispense unit 11 by the second transport unit 8 and the third transport unit 10.

That is, when joining of the tape T, cutting thereof, and stamping thereon have been completed, the holding unit 81 holds the bundled banknotes B, which is not shown in detail. Subsequently, the lower clamp portions 943 and 944 move downward, and the pressing force of the clamp unit 94 is released. Thereafter, the holding unit 81 transports the bundled banknotes B by a predetermined distance in the second horizontal direction toward a side opposite to the side toward which the banknotes have been transported into the large tape loop L2.

Next, holding of the bundled banknotes B by the holding unit 81 is released. Instead thereof, the third transport unit 10 holds the bundled banknotes B.

Subsequently, the third transport unit 10 transports the bundled banknotes B toward the dispense unit 11 in the first horizontal direction. When the bundled banknotes B approach the dispense unit 11, holding of the bundled banknotes B by the third transport unit 10 is gradually released. The bundled banknotes B are finally pushed onto the dispense unit 11 by the third transport unit 10.

The bundled banknotes that have been pushed onto the dispense unit 11 are dispensed to the outside of the housing 12 through the dispense port 111. The dispensed bundled banknote slides downward on the slanted surface provided at the first side surface 123 of the banknote handling apparatus 100.

<Solution to Jamming of Banknotes>

In the banknote handling apparatus 100 configured as described above, jamming of banknotes being transported may occur in the housing 12. The banknote handling apparatus 100 is provided with a structure for resolving such jamming of banknotes.

In the banknote handling apparatus 100, some portions of the housing 12 are configured to be openable/closable so that the inside of the housing 12 can be opened.

Specifically, substantially a lower half of the second side surface 124 of the housing 12 is provided with a lower cover 131. The lower cover 131 has the touch panel 17 at the front surface side thereof, and has the second outlets 53 of the non-bundling stackers 5 at the rear surface side thereof. The second outlets 53 protrude from the rear surface of the lower cover 131 as shown by the dashed lines in FIG. 1. The lower cover 131 is configured to be pivotable about a shaft extending in the up-down direction along a ridge portion between the third side surface 125 and the second side surface 124. As shown in FIG. 3, when the lower cover 131 is opened, the first handling unit 126 is exposed to the outside through the opening 1210 of the housing 12. FIG. 3 shows a state where the lower cover 131 is fully opened to uncover the opening 1210. In FIG. 3, the lower cover 131 is not shown.

Substantially a half of the upper surface 121 closer to the first side surface 123 and substantially a half portion, of substantially an upper half of the second side surface 124, closer to the first side surface 123 are provided with a bundling unit cover 132. The bundling unit cover 132 is continuously provided so as to cover a portion of the upper surface 121 and a portion of the second side surface 124. The bundling unit cover 132 is configured to be slidable toward the first side surface 123. As shown in FIG. 3, the bundling unit 9 is exposed when the bundling unit cover 132 is slid. Since the bundling unit cover 132 causes the bundling unit 9 to be exposed, a driving power supply (e.g., a power supply for applying voltage to the heater 95) of the banknote handling apparatus 100 is cut off when the bundling unit cover 132 is opened, in consideration of operator's safety.

As shown in FIG. 3, the bundling unit cover 132 is configured to be substantially within the range of the installation area of the banknote handling apparatus 100 when the bundling unit cover 132 is slid to a maximum extent. That is, the bundling unit cover 132 is configured to be slidable by substantially the same amount as the amount by which the dispense unit 11 protrudes from the first side surface 123. Thus, the bundling unit cover 132 is configured to be slidable, and moreover is substantially within the range of the installation area of the banknote handling apparatus 100 when being slid. Therefore, the bundling unit cover 132 can be opened even when a large empty space is not provided around the banknote handling apparatus 100. This configuration is particularly advantageous for a desktop banknote handling apparatus 100 for which it is difficult to provided a large empty space.

A portion, of the top surface 121, closer to the third side surface 125 is provided with a reel cover 133. The reel cover 133 is configured to be pivotable about a shaft extending in the horizontal direction along a ridge portion between the upper surface 121 and the third side surface 125. As shown in FIGS. 4 and 20, when the reel cover 133 is opened, the roll housing unit 911 is opened upward. This configuration enables setting and replacement of the tape roll TR in the roll housing unit 911.

As shown in FIGS. 4 and 20, the bundling unit cover 132 has an overlap portion 1321 provided to be one-step lower than the outer surface thereof. When the reel cover 133 is closed, a portion, of the reel cover 133, on the leading end side overlaps the upper side of the overlap portion 1321 of the closed bundling unit cover 132 (see an alternate long and short dash line in FIG. 20). The bundling unit cover 132 supports the closed reel cover 133. The overlap portion 1321 is located near the roller pair 9121 (operation roller 9122) of the tape transport unit 912, and the overlap portion 1321 has a notch 1322 that allows the operation roller 9122 to be exposed when the bundling unit cover 132 is closed. Thus, the tape roll TR is set in the roll housing unit 911 and the operation roller 9122 is operated to rotate with the reel cover 133 being opened and the bundling unit cover 132 being closed, whereby the leading end of the tape T can be tucked into the roller pair 9121. In the structure in which the driving power supply is cut off when the bundling unit cover 132 is opened as described above, when the bundling unit cover 132 is opened and the driving power supply is cut off, the temperature of the heater 95 may be lowered. Therefore, even when the bundling unit cover 132 is closed and cut-off of the driving power supply is canceled, it is necessary to stand by until the temperature of the heater 95 increases. Since setting and replacement of the tape roll TR are enabled without opening the bundling unit cover 132, the banknote handling apparatus 100 can be operated immediately after setting or replacement of the tape roll TR, and thus convenience for users is enhanced.

As shown in FIGS. 1 and 3, an upper portion of the third side surface 125 is provided with a side surface cover 134. The side surface cover 134 is, as conceptually shown in FIG. 3, configured to be pivotable about a shaft extending in the horizontal direction, in the vicinity of the boundary between the second handling unit 127 and the first handling unit 126. When the side surface cover 134 is opened, the transport path located near the downstream end portion of the first transport unit 7, that is, to the side of the bundling stacker 4, can be opened.

In the first handling unit 126 that is opened when the lower cover 131 is opened, the first transport path forming member 711, the second transport path forming member 712, the third transport path forming member 713, the fourth transport path forming member 714, and the fifth transport path forming member 715 are provided as described above, and the banknote transport path is formed by these members. Each of the transport path forming members 711 to 715 is configured to be pivotable about a predetermined pivotal shaft, and the transport path can be opened by pivoting each of the transport path forming members 711 to 715.

The pivotal configuration of each of the transport path forming members 711 to 715 will be described in detail with reference to FIGS. 2 and 3. First, as shown in FIG. 2, the first transport path forming member 711 forms a transport path extending in the up-down direction, on the downstream side of the recognition unit 3. The first transport path forming member 711 is disposed extending in the up-down direction, between the transport path extending in the up-down direction and the non-bundling stacker module 54. To the side of this transport path, the non-bundling stacker module 54 is disposed adjacent to this transport path, and there is no space that allows the first transport path forming member 711 to be displaced. As described above, the non-bundling stacker module 54 is configured to be slidable in the horizontal direction. As shown in FIG. 3, when the non-bundling stacker module 54 is slid toward the third side surface 125 (i.e., leftward in FIG. 3) so that the non-bundling stacker module 54 is away from the transport path, a space is formed between the non-bundling stacker module 54 and the first transport path forming member 711. Thus, the first transport path forming member 711 can be pivoted clockwise, about the pivotal shaft provided in an upper end portion thereof. A portion of the slid non-bundling stacker module 54 protrudes from the third side surface 125 of the housing 12.

As shown in FIG. 2, the second transport path forming member 712 forms a transport path extending from the above-described transport path extending in the up-down direction to the first diverging path 72*a*. The second transport path forming member 712 is located obliquely above the recognition unit 3, and obliquely extends. Above the recognition unit 3, an empty space expanding in the up-down direction and the horizontal direction is provided in advance. Using this empty space, the second transport path forming member 712 pivots clockwise, about the pivotal shaft provided in a lower end portion thereof, as shown in FIG. 3.

As shown in FIG. 2, the third transport path forming member 713 forms a transport path extending from the diverter mechanism 73 in the first diverging path 72*a* to the non-bundling stacker 5. The empty space expanding in the horizontal direction is provided below the second handling unit 127 and above the main transport path 71 that extends in the horizontal direction above the non-bundling stacker module 54. Using this empty space, the third transport path forming member 713 extending substantially in the horizontal direction pivots clockwise, about the pivotal shaft provided in an end portion thereof on the first side surface 123 side, as shown in FIG. 3.

As shown in FIG. 2, the fourth transport path forming member 714 forms a transport path extending in the horizontal direction above the non-bundling stacker module 54. The fourth transport path forming member 714 is disposed extending in the horizontal direction. Using the empty space provided above this transport path, the fourth transport path forming member 714 pivots counterclockwise, about the pivotal shaft provided in an end portion thereof on the third side surface 125 side, as shown in FIG. 3.

As shown in FIG. 2, the fifth transport path forming member 715 forms a transport path located above the non-bundling stacker module 54 and on the most downstream side in the first handling unit 126. The fifth transport path forming member 715 is disposed extending substantially in the up-down direction. The fifth transport path forming member 715 pivots by using the empty space provided above the non-bundling stacker module 54, as shown in FIG. 3, similarly to the third and fourth transport path forming members 713 and 714. Specifically, the fifth transport path forming member 715 pivots clockwise, about the pivotal shaft provided in a lower end portion thereof.

Further, the recognition unit 3 is also configured to be pivotable as described above. Using the empty space provided above the recognition unit 3, the recognition unit 3 pivots counterclockwise, about the pivotal shaft provided in an end portion thereof on the third side surface 125 side, as shown in FIG. 3.

The control unit 120 is configured to detect jamming of banknotes by using various sensors. When detecting jamming of banknotes, the control unit 120 guides an operator to the jamming of banknotes. Specifically, the control unit 120 displays, on the touch panel 17, a place where the jamming of banknotes occurs. By referring to the display on the touch panel 17, the operator opens the lower cover 131 to open the first handling unit 126 to be exposed, and pivots (i.e., displaces) any of the transport path forming members 711 to 715 and the recognition unit 3, corresponding to the place where the jamming of banknotes occurs. As described above, when displacing the first transport path forming member 711, the operator slides the non-bundling stacker module 54. Thus, the operator opens the transport path in the desired place to access the transport path, and removes banknotes jammed therein.

The respective transport path forming members 711 to 715, the recognition unit 3, and the non-bundling stacker module 54 are individually movable as described above. After these members and the like are moved and banknotes are removed to resolve jamming of the banknotes, these members and the like need to be moved to their original positions. However, the operator may forget to do this. So, the banknote handling apparatus 100 is configured such that the lower cover 131 cannot be closed unless the respective transport path forming members 711 to 715, the recognition unit 3, and the non-bundling stacker module 54 are moved to the original positions. Specifically, an interference portion (first interference portion 1311) is mounted to the rear surface of the lower cover 131, as shown by dashed lines in FIG. 1. The first interference portion 1311 extends in the horizontal direction, and protrudes from the rear surface of the lower cover 131. The first interference portion 1311 is configured to be located in the empty space provided above the non-bundling stacker module 54, as shown by dashed lines in FIG. 2. When the third transport path forming member 713, the fourth transport path forming member 714, and the fifth transport path forming member 715, which are configured to pivot by using this empty space, are located at the predetermined positions to form the corresponding transport paths, the positions of these members deviate from the first interference portion 1311 as shown in FIG. 5 (in FIG. 5, only the fourth transport path forming member 714 is shown), and therefore these members do not interfere with the first interference portion 1311. In this state, the operator can close the lower cover 131. When any of the third transport path forming member 713, the fourth transport path forming member 714, and the fifth transport path forming member 715 is not located at the predetermined position to form the transport path, even if the operator tries to close the lower cover 131, the operator cannot close the lower cover 131 because the transport path forming member (any of 713 to 715) interferes with the first interference portion 1311. This makes the operator recognize that any of the third transport path forming member 713, the fourth transport path forming member 714, and the fifth transport path forming member 715 is not located at the predetermined position.

The lower cover 131 is also provided with a second interference portion 1312 as shown by the dashed lines in FIG. 2. The second interference portion 1312 is disposed extending in the up-down direction, and is located within the empty space above the recognition unit 3. The second interference portion 1312 relates to the second transport path forming member 712 and the recognition unit 3 which are configured to pivot by using this empty space. When the second transport path forming member 712 and the recognition unit 3 are located at the predetermined positions, the second interference portion 1312 deviates from these members, whereby the lower cover 131 can be closed. When the second transport path forming member 712 or the recognition unit 3 are not located at the predetermined position, even if the operator tries to close the lower cover 131, the lower cover 131 cannot be closed because the second interference portion 1312 interferes with the second transport path forming member 712 or the recognition unit 3.

When the first transport path forming member 711 and the non-bundling stacker module 54 are located at the predetermined positions, these members do not interfere with the second outlets 53 protruding from the rear surface of the lower cover 131, whereby the lower cover 131 can be closed. When the first transport path forming member 711 or the non-bundling stacker module 54 is not located at the predetermined position, even if the operator tries to close the lower cover 131, the first transport path forming member 711 or the non-bundling stacker module 54 interferes with the second outlets 53. Thus, the second outlets 53 also serve as an interference portion.

CONCLUSION

The banknote handling apparatus 100 includes: the housing 12 having the opening 1210 that is opened and closed by the lower cover 131, and being configured so that the inside thereof can be opened through the opening 1210 when the lower cover 131 is opened; the first transport path forming member 711 disposed inside the housing 12, and configured to form a transport path that transports banknotes while sandwiching each banknote in a direction of the thickness of the banknote; and the non-bundling stacker module 54 disposed at a predetermined position inside the housing 12, and configured to perform predetermined handling on the banknotes being transported by the transport path.

When jamming of banknotes occurs in the middle of the transport path, the first transport path forming member 711 is displaced so as to open the transport path to be accessed in the state where the inside of the housing 12 is opened and exposed by the lower cover 131 being opened. The non-bundling stacker module 54 disposed adjacent to the transport path is movable from the predetermined position so as to form a space that allows the first transport path forming member 711 to be displaced.

According to the above configuration, when jamming of banknotes does not occur and the banknote handling apparatus 100 is normally operating, the non-bundling stacker module 54 in the housing 12 is located at a predetermined position adjacent to the transport path as shown in FIG. 2.

When jamming of banknotes occurs, the lower cover 131 is opened to open and expose the inside of the housing 12, and the first transport path forming member 711 is displaced to open the transport path to be accessed. At this time, as shown in FIG. 3, the non-bundling stacker module 54 disposed adjacent to the transport path is moved from the predetermined position so as to form a space that allows the first transport path forming member 711 to be displaced. Thus, the first transport path forming member 711 is displaced to open the transport path to be accessed, whereby the banknotes jammed in the middle of the transport path can be removed.

Since a space for displacement of the first transport path forming member 711 is not provided in the housing 12 in advance, the banknote handling apparatus 100 can be configured to be smaller in size. When jamming of banknotes is to be resolved, a necessary space is formed by moving the non-bundling stacker module 54, and the first transport path forming member 711 is displaced, whereby the transport path can be opened to be accessed.

Since a space for displacement of the first transport path forming member 711 is not provided in advance, the degree of freedom in layout of the transport path in the housing 12 is increased, and the degree of freedom in layout of the non-bundling stacker module 54 is also increased. This feature is also advantageous in downsizing the banknote handling apparatus 100. Therefore, this configuration can realize downsizing of the banknote handling apparatus 100 and reduction in the installation space associated with the downsizing, while providing a structure capable of resolving jamming of banknotes.

The housing 12 has, separately from the opening 1210, the second opening 1251 that allows the inside of the housing to communicate with the outside thereof. When the non-bundling stacker module 54 is moved from the predetermined position, a portion of the non-bundling stacker module 54 protrudes to the outside of the housing 12 through the second opening 1251.

When the non-bundling stacker module 54 is moved from the predetermined position, a portion of the non-bundling stacker module 54 protrudes to the outside of the housing 12 through the second opening 1251. Therefore, the empty space in the housing 12 can be removed as much as possible, thereby realizing further downsizing of the banknote handling apparatus 100. When jamming of banknotes occurs, it is only necessary to move the relatively small non-bundling stacker module 54 and cause at least a portion of the non-bundling stacker module 54 to protrude to the outside of the housing 12. Therefore, the empty space to be provided around the banknote handling apparatus 100 may be small. Thus, downsizing of the banknote handling apparatus 100 and reduction in the installation space for the apparatus are realized.

The non-bundling stacker module 54 is configured to close the second opening 1251 in the state where the non-bundling stacker module 54 is disposed at the predetermined position.

Thus, in the normal state where no jamming of banknotes occurs, the non-bundling stacker module 54 can also serve as a lid for closing the second opening 1251 provided in the housing 12.

A portion of the transport path extends in the up-down direction inside the housing. The non-bundling stacker module 54 is disposed to the side of the transport path extending in the up-down direction, and is movable in the horizontal direction so as to be away from the transport path.

According to this configuration, even if the non-bundling stacker module 54 is disposed to the side of and adjacent to the transport path extending in the up-down direction, since the non-bundling stacker module 54 is movable in the horizontal direction so as to be away from the transport path, a space can be formed between the transport path and the non-bundling stacker module 54. Thus, when jamming of banknotes occurs, the first transport path forming member 711 is displaced by using this space, whereby the transport path can be opened to be accessed. That is, the jammed banknotes can be removed from the transport path.

Since the empty space to the side of the transport path extending in the up-down direction is removed by disposing the non-bundling stacker module 54 to the side of and adjacent to the transport path, the width (or depth) of the banknote handling apparatus 100 is reduced to reduce the installation area. This feature is advantageous in achieving downsizing of the banknote handling apparatus 100 and reduction in the installation space.

In the banknote handling apparatus disclosed in Patent Literature 2 (Japanese Laid-Open Patent Publication No. 2013-250909) described above, the entirety of the upper handing unit connected by hinge is pivoted upward to open and expose the inside of the banknote handling apparatus. In this configuration, however, empty space that enables pivoting of the upper handing unit should be provided around the paper sheet handling apparatus in advance, resulting in a disadvantage that a large installation space is needed.

In contrast thereto, the banknote handling apparatus 100 described above is a paper sheet handling apparatus including the housing 12, and a cover (i.e., the bundling unit cover 132) that is openable and closable so as to be switched between a state where the cover closes and hide the inside of the housing and a state where the cover opens and expose the inside of the housing 12. The bundling unit cover 132 is slid and moved to be switched between the state where the cover 132 closes and hide the inside of the housing 12 and the state where the cover 132 opens and expose the inside of the housing 12 (see FIG. 1).

According to this configuration, since the bundling unit cover 132 is slid and moved, the bundling unit cover 132 can be opened to open and expose the inside of the banknote handling apparatus 100 even when a large empty space is not provided around the apparatus 100, in contrast to the configuration disclosed in Patent Literature 2 in which the entirety of the upper handling unit is pivoted. This configuration realizes downsizing of the banknote handling apparatus and reduction in the installation space.

In the case where the entirety of the upper handing unit is pivoted, an operator should stand up to pivot the upper handling unit even when the apparatus is installed on a desk. However, in the case where the bundling unit cover 132 is slid and moved, an operator can open the bundling unit cover 132 while seated. This feature improves operability of the operator.

The bundling unit cover 132 is configured to slide and move in the horizontal direction, and is further configured to be housed within the range of the installation area of the banknote handling apparatus 100 when being moved in the direction to open the inside of the housing 12 (see FIG. 3).

Thus, when the bundling unit cover 132 is opened, the bundling unit cover 132 does not significantly exceed the range of the installation area of the banknote handling apparatus 100, and therefore, it is not necessary to secure a large empty space around the banknote handling apparatus 100. This feature is particularly advantageous in reducing the installation space for a desktop apparatus.

The bundling unit cover 132 is continuously provided so as to cover a portion of the upper surface 121 of the housing 12 and at least a portion of the second side surface 124 of the housing 12. The banknote handling apparatus 100 is further provided with a second cover (i.e., the reel cover 133) that covers a portion of the upper surface 121 of the housing 12 and is opened so as to pivot upward. When the reel cover 133 is closed, a portion of the reel cover 133 overlaps the upper side of the bundling unit cover 132 that covers the inside of the housing 12 (see FIGS. 4 and 20).

Therefore, when the upwardly pivotable reel cover 133 is closed, the reel cover 133 can be supported by the bundling unit cover 132.

The banknote handling apparatus 100 is configured to perform the process of bundling stacked paper sheets with a tape T. The reel cover 133 is provided inside the housing 12, and is configured to open or close upward the roll housing unit 911 that houses the tape roll TR which is the rolled tape T. Inside the housing 12, the roller pair 9121 that holds the tape T drawn from the tape roll TR and feeds the tape T is provided adjacent to the roll housing unit 911. The roller pair 9121 is provided with an operation unit (i.e., the operation roller 9122) that operates to cause the leading end of the tape T to be tucked into the roller pair 9121. The bundling unit cover 132 is formed so as to expose the operation roller 9122, in the state where the reel cover 133 is opened and the bundling unit cover 132 covers the inside of the housing 12 (see FIGS. 4 and 20).

Thus, an operator can set or replace the tape reel TR by only opening the reel cover 133 even when the bundling unit cover 132 is closed, thereby improving operability of the operator.

OTHER EMBODIMENTS

The above embodiments have been described as an example of the technique disclosed in the present application. However, the technique in the present disclosure is not limited to the embodiments, but is also applicable to embodiments which are altered or substituted, to which other features are added, or from which some features are omitted, as needed. Optionally, the components described in the embodiments may be combined to create a new embodiment. The components illustrated on the accompanying drawings and described in the detailed description include not only essential components that need to be used to overcome the problem, but also other unessential components that do not have to be used to overcome the problem and that are used for illustrating the technique. Therefore, such unessential components should not be taken for essential ones, simply because such unessential components are illustrated in the drawings or mentioned in the detailed description.

The above embodiment may have the following configuration.

In the above embodiment, as an example of the paper sheet handling apparatus, the banknote handling apparatus 100 is described. The paper sheet handling apparatus is not limited thereto. For example, recognition, distribution, and stacking of the paper sheets may be performed by another device, and the paper sheet handling apparatus may be an apparatus that merely performs a process of transporting loose paper sheets and stacking the paper sheets in the stacking unit, and then transporting the paper sheets stacked in the stacking unit to another place by the transport unit. Banknotes are described as an example of paper sheets. However, the paper sheets are not limited to banknotes, and may be cash vouchers such as gift coupons.

The paper sheet handling apparatus may be a banknote depositing machine, a banknote dispensing machine, a banknote depositing and dispensing machine, and the like.

In the above configuration, the handling unit configured to be movable is the non-bundling stacker module 54. However, another handling unit may be configured to be movable. In addition, a space that allows a transport path forming member other than the first transport path forming member 711 to be displaced may be provided by moving the handling unit.

In the banknote handling apparatus 100, the layout of the transport path in the first handling unit 126 and the layouts of the respective handling units are merely examples, and other layouts than those illustrated may be adopted as appropriate.

Figure 21:
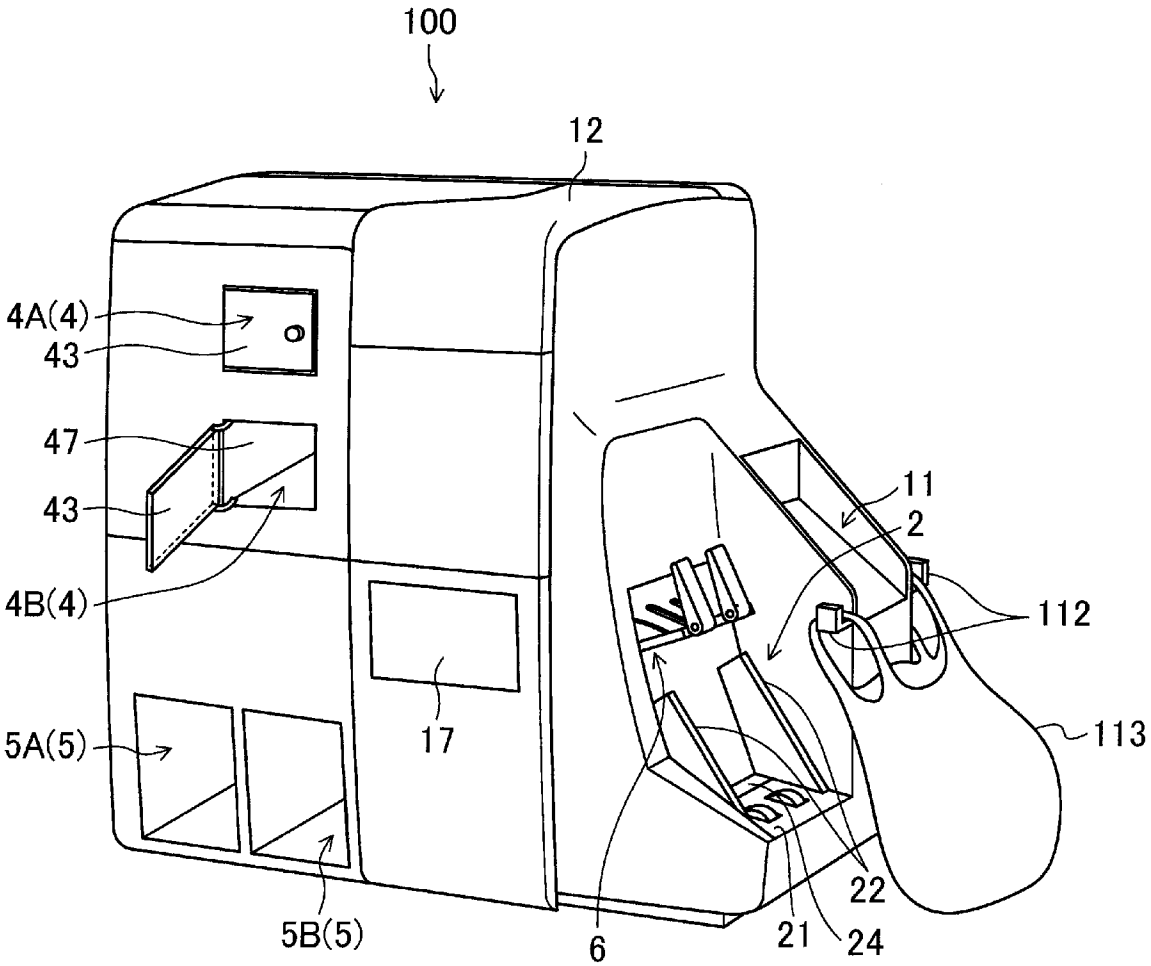
FIG. 21 is a perspective view showing a modification of the banknote handling apparatus.

For example, hooks 112 on which a bag 113 can be hung may be provided near the dispense unit 11 of the banknote handling apparatus 100, as shown in FIG. 21. A bundled banknote that has been discharged through the dispense port 111 slides downward on the slant surface provided at the first side surface 123, as described above. With the bag 113 hanged on the hooks 112, the sliding bundled banknote can be automatically cast into the bag.

Further, the cover that slides in the banknote hung apparatus 100 is not limited to the bundling unit cover 132, and other covers may be slidably configured.

DESCRIPTION OF THE REFERENCE CHARACTERS

12 housing
100 banknote handling apparatus (paper sheet handling apparatus)
1210 opening
1251 second opening
131 lower cover (opening and closing unit)
54 non-bundling stacker module (handling unit, stacker)
711 (first) transport path forming member
7 first transport unit
B banknote (paper sheet)
T tape
TR tape roll

The invention claimed is:

1. A paper sheet handling apparatus comprising:

a housing having a first opening that is opened and closed by an opening and closing unit, the housing being configured such that the inside thereof can be accessed through the first opening when the opening and closing unit opens the first opening;

a transport path forming member disposed inside the housing, the transport path forming member being configured to form a transport path that transports paper sheets while sandwiching each paper sheet in a direction of the thickness of the paper sheet; and a stacker disposed at a predetermined position inside the housing, the stacker being configured to stack the paper sheets being transported by the transport path, wherein when jamming of paper sheets occurs in the transport path, the transport path forming member is displaceable so as to open the transport path, in a state where the inside of the housing is opened by the opening and closing unit, and the stacker disposed adjacent to the transport path is movable from the predetermined position so as to form a space that allows the transport path forming member to be displaceable.

2. A paper sheet handling apparatus comprising:

a housing having a first opening that is opened and closed by an opening and closing unit, the housing being configured such that the inside thereof can be accessed through the first opening when the opening and closing unit opens the first opening;

a transport path forming member disposed inside the housing, the transport path forming member being configured to form a transport path that transports paper sheets while sandwiching each paper sheet in a direction of the thickness of the paper sheet; and a handling unit disposed at a predetermined position inside the housing, the handling unit being configured to perform predetermined handling on the paper sheets being transported by the transport path, wherein when jamming of paper sheets occurs in the transport path, the transport path forming member is displaceable so as to open the transport path, in a state where the inside of the housing is opened by the opening and closing unit, the handling unit disposed adjacent to the transport path is movable from the predetermined position so as to form a space that allows the transport path forming member to be displaceable, the housing is disposed with a second opening, different from the first opening, that allows the inside of the housing to communicate with the outside thereof, and at least a portion of the handling unit protrudes to the outside of the housing through the second opening when the handling unit is moved from the predetermined position.

3. The paper sheet handling apparatus according to claim 2, wherein the handling unit is configured to close the second opening in a state where the handling unit is disposed at the predetermined position.

4. The paper sheet handling apparatus according to claim 2, wherein a portion of the transport path extends in an up-down direction inside the housing, and the handling unit is disposed to a side of the transport path extending in the up-down direction, and is movable in a horizontal direction so as to be away from the transport path.

5. The paper sheet handling apparatus according to claim 2, wherein the handling unit is a stacker configured to stack the paper sheets.

6. A paper sheet handling apparatus comprising:

a housing having a first opening and a cover that can open and close the first opening;

a receiving unit configured to receive paper sheets from outside to inside of the housing;

a transport unit that is disposed inside of the housing and transports the paper sheets received by the receiving unit, the transport unit having a transport path formed by a transport path forming member; and a stacker that is disposed inside of the housing and configured to stack the paper sheets transported by the transport unit, wherein the housing is configured such that the inside of the housing is exposed through the first opening when the cover opens the first opening, the transport path forming member is displaceable so as to make the transport unit accessible when the cover opens the first opening, and the stacker disposed adjacent to the transport unit is movable so as to form a space that allows the transport path forming member to be displaced.

7. The paper sheet handling apparatus according to claim 6, wherein the housing is disposed with a second opening, different from the first opening, that allows the inside of the housing to communicate with the outside thereof, and at least a portion of the handling unit protrudes to the outside of the housing through the second opening when the handling unit is moved from the predetermined position.

8. The paper sheet handling apparatus according to claim 6, wherein the stacker is configured to close the second opening in a state where the handling unit is disposed at the predetermined position.

9. The paper sheet handling apparatus according to claim 6, wherein a portion of the transport unit extends in an up-down direction inside the housing, and the stacker is disposed to a side of the transport unit extending in the up-down direction, and is movable in a horizontal direction so as to be away from the transport unit.

* * * * *